US006105813A

United States Patent [19]

Abbey

[11] Patent Number: 6,105,813

[45] **Date of Patent: *Aug. 22, 2000**

[54] MULTI PURPOSE PAINT BUCKET

[75] Inventor: Bert H. Abbey, Guilford, Conn.

[73] Assignee: Roller Coater, Inc., Guilford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,574

[22] Filed: Jun. 25, 1997

[51] Int. Cl.[7] ..... B65D 7/00

[52] U.S. Cl. ..... 220/570; 220/501; 220/736

[58] Field of Search ..... 220/501, 520, 220/570, 736, 697

[56] References Cited

U.S. PATENT DOCUMENTS

| | | | |
|---|---|---|---|
| D. 28,095 | 12/1897 | Mills . | |
| D. 186,195 | 9/1959 | Cole . | |
| D. 202,134 | 8/1965 | Bryan | D58/17 |
| D. 212,563 | 10/1968 | Tidwell . | |
| D. 212,831 | 11/1968 | Koch | D49/29 |
| D. 248,335 | 6/1978 | Cooke et al. . | |
| D. 293,144 | 12/1987 | Papke et al. | D32/53.1 |
| D. 303,304 | 9/1989 | Sabatino | D32/53 |
| D. 352,143 | 11/1994 | Arshinoff | D32/53 |
| D. 364,017 | 11/1995 | Moffitt | D32/53.1 |
| 775,526 | 11/1904 | Dunbar . | |
| 876,808 | 1/1908 | Kinert | 220/501 |
| 1,063,724 | 6/1913 | Patterson | 220/571 |
| 1,562,074 | 11/1925 | Baum | 220/564 |
| 1,848,331 | 3/1932 | Essingler . | |
| 2,215,691 | 9/1940 | East | 220/501 |
| 2,287,156 | 6/1942 | White . | |
| 2,661,858 | 12/1953 | Howell | 220/1 |
| 2,705,334 | 4/1955 | Farrow . | |
| 2,712,668 | 7/1955 | Thiele . | |
| 2,738,915 | 3/1956 | St. Clair | 220/575 |
| 2,827,648 | 3/1958 | Geisz | 15/121.2 |
| 2,849,158 | 8/1958 | Hopla . | |
| 2,893,030 | 7/1959 | Averna | 15/121.2 |
| 2,896,809 | 7/1959 | Metzger et al. . | |
| 3,292,815 | 12/1966 | Smith et al. | 220/94 |
| 3,351,970 | 11/1967 | Engh | 15/257.06 |
| 3,493,988 | 2/1970 | Tidwell | 15/257.06 |
| 3,514,012 | 5/1970 | Martin . | |
| 3,553,762 | 1/1971 | Padgett, Jr. et al. | 15/257.06 |
| 3,828,389 | 8/1974 | Heisler . | |
| 4,094,431 | 6/1978 | Wheeler . | |
| 4,145,789 | 3/1979 | Morgan, Sr. . | |
| 4,164,229 | 8/1979 | Fuhr . | |
| 4,164,299 | 8/1979 | Fuhr . | |
| 4,297,762 | 11/1981 | Crysdale . | |
| 4,444,306 | 4/1984 | Benaquista | 220/501 |
| 4,509,226 | 4/1985 | Allison et al. . | |
| 4,706,918 | 11/1987 | Wilson | 248/210 |
| 4,756,046 | 7/1988 | Surface et al. . | |
| 4,852,738 | 8/1989 | Craig et al. | 220/575 |
| 4,927,046 | 5/1990 | Armstrong . | |
| 5,046,749 | 9/1991 | Owens . | |
| 5,054,661 | 10/1991 | Hollje . | |
| 5,072,868 | 12/1991 | Dickie et al. | 224/252 |
| 5,207,348 | 5/1993 | Fischer et al. . | |
| 5,322,183 | 6/1994 | Strachan . | |
| 5,328,051 | 7/1994 | Potter et al. | 220/501 |
| 5,341,969 | 8/1994 | Accardo et al. . | |
| 5,400,916 | 3/1995 | Weber . | |
| 5,511,279 | 4/1996 | Ippolito . | |
| 5,549,216 | 8/1996 | Scholl . | |

*Primary Examiner*—Joseph M. Moy
*Attorney, Agent, or Firm*—Fleshner & Kim, LLP

[57] ABSTRACT

A multi-compartment receptacle for liquids includes a main compartment and an integral cup compartment. Structural provisions allow for the convenient transfer of relatively small quantities of liquid from the main compartment to the cup compartment. The cup compartment is suitable for holding a paint brush as well as a relatively small volume of liquid. The receptacle, including the integral cup, can be inexpensively and rapidly produced by a molding process from plastic materials, such as polyethylene. Methods of making such a receptacle are also disclosed, together with methods for transferring liquids between the main compartment and the cup compartment.

18 Claims, 24 Drawing Sheets

FRONT VIEW OF MAIN WALL SHOWING POSITION OF TANGENTIAL WALLS AND CUP

SIDE VIEW OF
TANGENTIAL WALL 51/61
WITH CHANNEL 71/81

METHOD OF MAKING A PLASTIC BUCKET I

METHOD OF MAKING A PLASTIC BUCKET II

MULTI PURPOSE PAINT BUCKET

BACKGROUND OF THE INVENTION

1. Field of the Invention

This invention relates to a bucket, pail, can, or other receptacle having a main compartment and an integral cup. In particular, this invention relates to a bucket, pail, can, or other receptacle having a main compartment and an integral cup compartment, wherein the main compartment and the cup compartment are separate, and provision is made for the facile transfer of liquid material between the main compartment and the integral cup. More particularly, this invention relates to a bucket, pail, can, or other receptacle having a main compartment and an integral cup, wherein even when a liquid material is at a low level within the main compartment, the liquid material may be readily transferred from the main compartment to the integral cup. This invention further relates to a receptacle for paint, wherein the receptacle has a main compartment and an integral cup. This invention still further relates to a method of making a receptacle having a main compartment and an integral cup, wherein the receptacle allows for the facile transfer of liquid material from the main compartment to the integral cup.

2. Background of the Related Art

Paint, other coatings, adhesives, other liquid emulsions, suspensions, solutions, and the like, may be applied to a surface with a roller, a brush, or as a spray, etc. One of the most convenient and efficient means for applying such materials is with a roller. However, when working (e.g. painting) with a roller, there is still a need for a brush for painting trim, corners, etc. where a roller will not fit or is otherwise unsuitable. There is a need for a receptacle having at least two compartments: a larger main compartment and a smaller compartment or cup, wherein the main compartment is suitable for containing paint to be applied to a roller, and the cup is suitable for applying paint to a brush, and furthermore, wherein paint can be readily transferred from the main compartment to the cup, even when the paint in the main compartment is at a relatively low level. Paint roller equipment, including trays and buckets of various shapes and designs, with or without partitions or inserts of various types, are old in the art. For example, U.S. Pat. No. 1,848,331 to Esslinger discloses a multiple compartment pail, in one embodiment of which compartments of equal height are formed by a partition which extends the full height of the pail from base to rim. In another embodiment the pail serves as a holder for inserts, and the inserts form the compartments. U.S. Pat. No. 2,705,334 discloses a paint roller wiping device, including a plate for mounting within a paint bucket, and a shelf which can accommodate a paint brush. No provision is made in the '334 for the shelf to contain paint, nor for the transfer of paint from the paint bucket to the shelf. U.S. Pat. No. 2,712,668 discloses a scrub bucket having a central, vertical partition therein, thereby providing a bucket having two compartments of equal depth, surface area, and volume. The partition of the '668 is intended to prevent exchange of liquid between the two compartments. U.S. Pat. No. 2,896,809 discloses a partitioned pail wherein the partition extends diametrically across the middle of the pail to provide two substantially semi-circular bottom sections. Thus the two partitions are substantially of equal depth, surface area, and volume. The partition terminates at a height below the top edge or rim of the pail or receptacle. The partition is open on the bottom and sides so that a series of the pails can be stacked or nested. U.S. Pat. No. 4,145,789 discloses a paint distributing plate, and a paint retaining and distributing apparatus including a planar sheet for insertion into an open-mouth receptacle or bucket. The planar sheet contacts the base of the bucket/receptacle, thus providing two "compartments" of equal height. The planar sheet has a plurality of holes therein which permit the passage of paint therethrough, consequently the two compartments together comprise an open system. U.S. Pat. No. 4,927,046 discloses a pentagonal-shaped bucket which includes a ledge for resting a paint brush thereon. The '046 does not disclose any internal walls, partitions or separate compartments within the bucket for containing any type of liquids. Further, no structural elements are included in the disclosure of the '046 to provide for transferring a liquid to the ledge or for retaining a volume of liquid on the ledge. Thus, with respect to containing liquids, the bucket of the '046 has only a single compartment with the bucket in the normal upright position. None of the above references teach a receptacle which includes a main compartment suitable for painting with a roller and a smaller compartment suitable for painting with a brush, wherein structural elements are provided for the transfer of paint from the main compartment to the smaller compartment. The structure of the instant invention fulfills the needs outlined above, as will be described fully hereinbelow.

The instant invention provides a substantially cylindrical or frusto-conical receptacle for paint, or the like, which can be provided in a range of sizes for numerous different purposes at relatively little expense on a per unit basis. Additional advantages and features of the receptacle of Applicant will become readily apparent from the following account thereof.

The above references are incorporated by reference herein where appropriate for appropriate teachings of additional or alternative details, features, and/or technical background.

SUMMARY OF THE INVENTION

An object, therefore, of the invention is to provide a receptacle having two separate compartments of unequal depth.

Another object of the invention is to provide a bucket having a body including a main compartment and an integral cup compartment.

Another object of the invention is to provide a bucket having a body including a bucket outer side, a main compartment, and an integral cup compartment; wherein the cup compartment is external to the bucket outer side.

Another object of the invention is to provide a bucket having a body including a main compartment and an integral cup compartment.

Another object of the invention is to provide a bucket having a body including a main compartment, an integral cup compartment, and one or more channels through which liquid can flow from the main compartment to the cup compartment.

Another object of the invention is to provide a multi-compartment bucket-like receptacle suitable for painting, concurrently, with a roller and a brush.

Another object of the invention is to provide a method for making a bucket-like receptacle which can be simply produced from a plastic material by a molding process.

Another object of the invention is to provide a method for transferring liquid from a main compartment of a bucket to a cup compartment integral with the same bucket.

One advantage of the invention is that it provides a multi-compartment bucket having a larger main compartment and a smaller cup compartment integral with the bucket.

Another advantage of the invention is that it provides a multi-compartment bucket having a main compartment and a cup compartment integral with the bucket, wherein liquid can be conveniently transferred from the main compartment to the cup compartment by tilting the bucket.

Another advantage of the invention is that it provides a multi-compartment bucket having a main compartment and a cup compartment integral with the bucket, wherein both the main compartment and the cup compartment can separately contain a liquid.

Another advantage of the invention is that it provides a multi-compartment bucket having a main compartment and a cup compartment integral with the bucket, wherein both the main compartment and the cup compartment are self-contained.

Another advantage of the invention is that it provides a multi-compartment bucket having a main compartment and a cup compartment integral with the bucket, wherein the main compartment and the cup compartment each have a pouring spout.

Another advantage of the invention is that it provides a multi-compartment bucket suitable for containing paint, the bucket including a main compartment, a main wall, and a cup compartment integral with the bucket, wherein the main compartment is suitable for holding a relatively large volume of paint, the main wall is suitable for applying and distributing paint over a roller, and the cup compartment is suitable for containing a relatively small volume of paint and/or a paint brush.

Another advantage of the invention is that it provides a multi-compartment bucket having a main compartment and a cup compartment integral with the bucket, wherein the bucket can be constructed by a simple molding process from plastic materials.

Another advantage of the invention is that it provides a method of making a multi-compartment bucket by a molding process from plastic materials, wherein the bucket has a main compartment and a cup compartment integral with the bucket.

Another advantage of the invention is that it provides a method for conveniently transferring a liquid from a main compartment of a multi-compartment bucket to a cup compartment integral with the bucket.

One feature of the invention is that it provides a bucket-like receptacle including a main compartment of relatively large capacity and a cup compartment of relatively small capacity.

Another feature of the invention is that it provides a multi-compartment bucket which includes a main compartment, a cup compartment integral with the bucket, and at least one channel disposed between the main compartment and the cup compartment.

Another feature of the invention is that it provides a multi-compartment bucket which includes a main compartment, and a cup compartment integral with the bucket, wherein the bucket has a body including a bucket inner side straight section having a surface suitable for applying and distributing paint to a paint roller.

Another feature of the invention is that it provides a multi-compartment bucket which includes a bucket outer side, a main compartment, and an integral cup compartment, wherein the cup compartment at least partially protrudes from the bucket outer side.

Another feature of the invention is that it provides a multi-compartment bucket which includes a main compartment, a cup compartment integral with the bucket, and at least one internal wall including at least one channel in the at least one internal wall.

Another feature of the invention is that it provides a multi-compartment bucket which includes a bucket outer side, a main compartment, and an integral cup compartment, wherein the cup compartment is external to the bucket outer side.

Another feature of the invention is that it provides a multi-compartment bucket which includes a bucket outer side, a main compartment, and an integral cup compartment, wherein the cup compartment is internal to the bucket outer side.

Another feature of the invention is that it provides a multi-compartment bucket which includes a main compartment, a cup compartment integral with the bucket, a main wall, and left and right tangential walls, wherein at least one of the left and right tangential walls has at least one channel therein to allow liquid to flow from the main compartment to the cup compartment.

Another feature of the invention is that it provides a multi-compartment bucket, which includes a main compartment and a cup compartment integral with the bucket, wherein a liquid can be retained separately within the main compartment and within the cup compartment.

Another feature of the invention is that it provides a multi-compartment bucket, which includes a main compartment, left and right tangential walls, and a cup compartment integral with the bucket, wherein a liquid can be conveniently transferred from the main compartment to the cup compartment via at least one channel in the left and right tangential walls.

These and other objects, advantages and features are accomplished by the provision of a bucket for containing liquid, including: a main compartment; a cup compartment integral with the bucket; a bucket outer side; and a channel disposed between the main compartment and the cup compartment.

These and other objects, advantages and features are accomplished by the provision of a bucket for containing a liquid, including: a main compartment for containing a liquid; a cup compartment for containing a liquid; a bucket rim; a bucket outer side; and a bucket inner side, the bucket inner side including a bucket inner side straight section disposed between the main compartment and the cup compartment, the bucket inner side straight section having at least one channel therein.

These and other objects, advantages and features are accomplished by the provision of a bucket for containing a liquid, including: a main compartment for containing a liquid; a cup compartment for containing a liquid; a bucket rim; a bucket outer side; and a bucket inner side, the bucket inner side including a bucket inner side straight section, the bucket inner side straight section having a straight section rim, the straight section rim lower than the bucket rim and the straight section rim forming a channel disposed between the main compartment and the cup compartment.

These and other objects, advantages and features are accomplished by the provision of a bucket for containing a liquid, including: a substantially cylindrical or frusto-conical body including a bucket base and a rim; a main compartment; and a cup integral with the body, the cup separated from the main compartment by at least one internal wall internal to the body.

These and other objects, advantages and features are accomplished by the provision of a bucket for containing a liquid, including: a substantially cylindrical or frusto-conical body including a bucket base and a rim; a main compartment; and a cup integral with the body, the cup separated from the main compartment by at least one internal wall internal to the body, wherein the at least one internal wall comprises a main wall and at least one tangential wall, and the at least one tangential wall includes at least one channel, and the at least one channel allows the transfer of the liquid from the main compartment to the cup.

These and other objects, advantages and features are accomplished by the provision of a bucket for containing a liquid, including: a substantially cylindrical or frusto-conical body including a bucket base and a rim; a main compartment; and a cup integral with the body, the cup separated from the main compartment by at least one internal wall, the at least one internal wall internal to the body, wherein the cup is separated from the main compartment by a main wall, a first tangential wall, and a second tangential wall; wherein the first tangential wall and the second tangential wall comprise a left side of the cup and a right side of the cup, respectively, and at least one of the first tangential wall and the second tangential wall includes a channel for allowing transfer of the liquid from the main compartment to the cup.

These and other objects, advantages and features are accomplished by the provision of a bucket for containing a liquid, including: a substantially cylindrical or frusto-conical body including a bucket base and a rim; a main compartment; and a cup integral with the body, the cup separated from the main compartment by at least one internal wall internal to the body, wherein the main compartment has a main compartment base which includes a rear main compartment base and a front main compartment base, and the surface area of the rear main compartment base exceeds the surface area of the front main compartment base by a factor of from about 2 to a factor of about 50.

These and other objects, advantages and features are accomplished by the provision of a multi-compartment bucket for containing paint, including: a body having a rim, first and second pouring spouts, a bucket inner side, a bucket outer side, and a bucket base; a main compartment having a main compartment base; and a cup compartment having a cup compartment base.

These and other objects, advantages and features are accomplished by the provision of a multi-compartment bucket for containing paint, including: a body having a rim, first and second pouring spouts, a bucket inner side, a bucket outer side, and a bucket base; a main compartment having a main compartment base; and a cup compartment having a cup compartment base, wherein the cup compartment protrudes from the bucket outer side at a position on the bucket outer side located beneath the second pouring spout.

These and other objects, advantages and features are accomplished by the provision of a multi-compartment bucket for containing paint, including: a body having a rim, first and second pouring spouts, a bucket inner side, a bucket outer side, and a bucket base; a main compartment having a main compartment base; a cup compartment having a cup compartment base; a main wall; and left and right tangential walls; wherein the bucket inner side, the main wall and the left and right tangential walls jointly form the cup compartment, and the left and right tangential walls include at least one channel therein, and the at least one channel allows for the transfer of paint from the main compartment to the cup compartment.

These and other objects, advantages and features are accomplished by the provision of a method of transferring liquid between a main compartment of a bucket and a cup compartment integral with the bucket, including the steps of: providing a liquid in the main compartment, wherein the bucket is in a substantially level position, and the main compartment is separated from the cup compartment by a bucket inner side straight section, the bucket inner side straight section including at least one channel, the at least one channel allowing liquid to flow between the main compartment and the cup compartment when the bucket is tilted from the substantially level position to a sufficient extent in a direction generally towards the cup compartment; tilting the bucket from the substantially level position to a sufficient extent in the direction generally towards the cup compartment until a desired amount of liquid has flowed from the main compartment through the at least one channel to the cup compartment; and returning the bucket to the substantially level position.

These and other objects, advantages and features are accomplished by the provision of a method of transferring liquid between a main compartment within a bucket and a cup compartment within the bucket, including the steps of: providing a liquid in the main compartment, wherein the bucket is in a substantially level position, and the main compartment is separated from the cup compartment by a main wall and first and second tangential walls, the main wall being entire, and the first and the second tangential walls having first and second channels therein, respectively, each of the first and the second channels allowing liquid to flow from the main compartment to the cup compartment when the bucket is tilted from the substantially level position to a sufficient extent in a direction generally towards the cup compartment; tilting the bucket from the substantially level position to a sufficient extent in the direction generally towards the cup compartment until a desired amount of liquid has flowed from the main compartment through at least one of the first and the second channels to the cup compartment; and returning the bucket to the substantially level position.

These and other objects, advantages and features are accomplished by the provision of a method for making a plastic bucket, including the steps of: providing a mold for the plastic bucket, wherein the mold includes a bucket outer side portion, a main compartment portion, a cup compartment portion, and a channel portion disposed between the main compartment portion and the cup compartment portion; providing plastic material for the plastic bucket; placing the plastic material in the mold; forming the plastic bucket from the plastic material; removing the plastic bucket from the mold; and attaching a handle to the bucket.

These and other objects, advantages and features will become more apparent from the following description of embodiments thereof taken in conjunction with the accompanying drawings.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The instant invention provides a multi-compartment bucket or bucket-like receptacle suitable for containing paint or other liquids, the bucket including a main compartment of relatively large capacity, and a cup compartment of relatively small capacity, wherein the cup compartment is integral with the bucket. In situations where the liquid contained in the bucket is paint, the main compartment is suitable for holding a relatively large volume of paint for applying to a roller, and the cup compartment is suitable for containing a relatively small volume of paint and/or a paint brush. The cup compartment may be internal or external to the bucket outer side; in both cases the cup compartment is integral with the bucket.

Figure 1A:
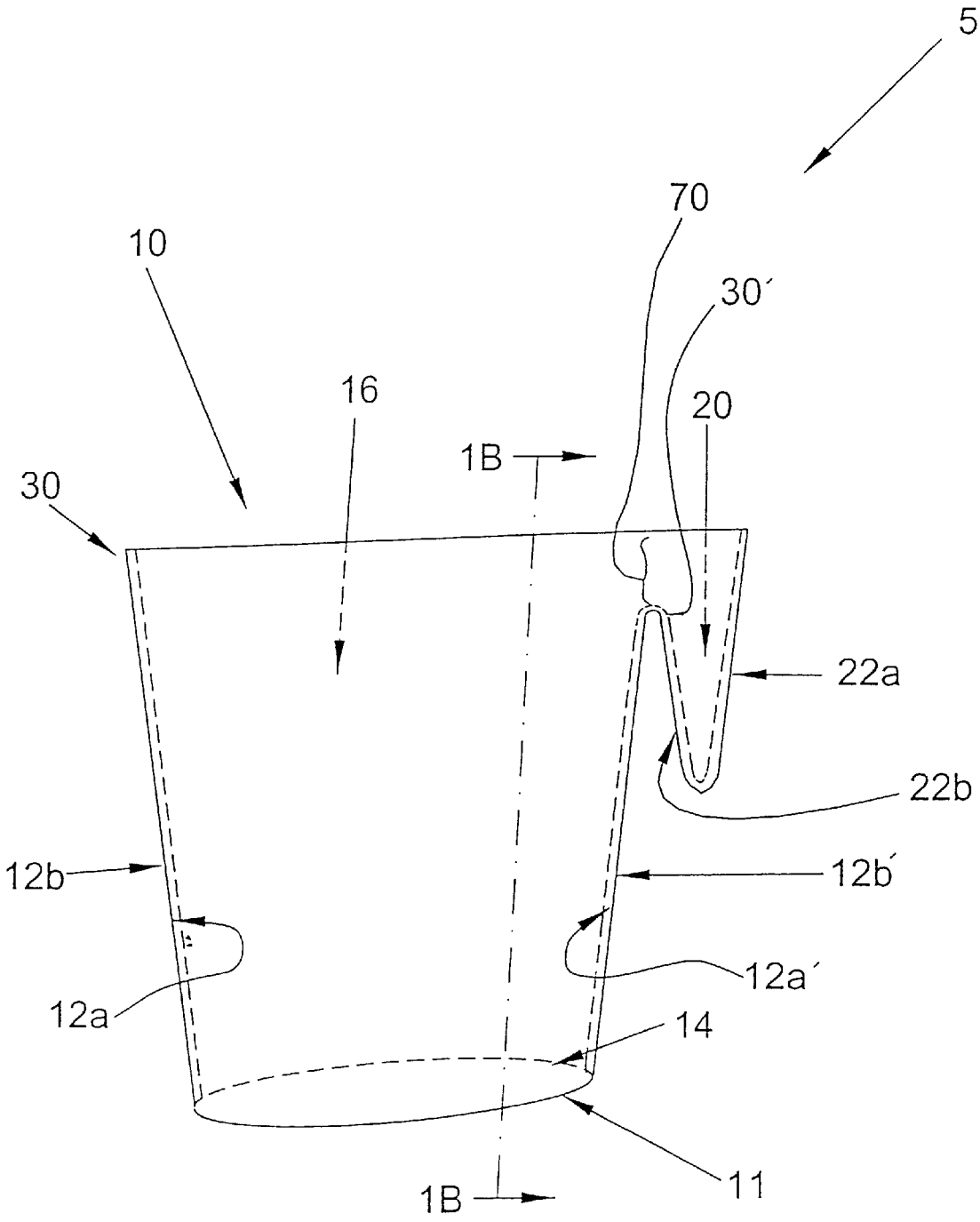
FIG. 1A shows a sectional view of a bucket according to one embodiment of the invention, in which the bucket has no internal walls, the cup compartment is external to the bucket outer side, and a channel is formed by the straight section rim.

Referring to the drawings, FIG. 1A shows a sectional view of a bucket, pail, or bucket-like receptacle 5 according to one embodiment of the invention. Herein the terms "pail" and "bucket" will be used synonymously. The bucket 5 of the instant invention has a body 10, including a main compartment 16, a cup or cup compartment 20, a bucket base 11, a bucket rim 30, a bucket inner side 12*a*, a bucket outer side 12*b*, and a bucket inner basal edge 14. Main compartment 16 includes main compartment base 17, which according to certain embodiments of the invention may correspond to the interior part of bucket base 11. According to the embodiment illustrated in FIGS. 1A–F, cup 20 is external to bucket outer side 12*b*, and bucket 5 lacks an internal wall.

Body 10 may be more or less cylindrical or frusto-conical in shape. However, bucket inner side 12*a* and bucket outer side 12*b* may include a bucket inner side straight section 12*a*' (and a corresponding bucket outer side straight section 12*b*'). Bucket inner side straight section 12*a*' includes a straight section rim 30'. Straight section rim 30' is straight or substantially straight and may have a length ranging from about 0.30 to about 0.99 times the diameter of bucket rim 30. Straight section rim 30' is lower than bucket rim 30, thereby forming a channel 70 for the flow or passage of liquids from main compartment 16 to cup compartment 20. Cup compartment 20 is located adjacent to bucket outer side straight section 12*b*'. Channel 70 permits the facile and convenient transfer of liquids from the main compartment 16 to cup compartment 20. According to one embodiment of the invention, channel 70 may extend the entire length of straight section rim 30'. Alternatively, bucket inner side straight section 12*a*' may include at least one channels positioned at specific locations of straight section rim 30'; and according to a currently preferred embodiment, left and right channels 71/81 are located at left and right edges 30'*a*, 30'*b*, respectively, of straight section rim 30' (FIGS. 1C, 1D).

Preferably the overall height of bucket 5 from bucket base 11 to bucket rim 30 is from about 6 inches to about 36 inches. Preferably the overall height of bucket 5 ranges from about 8 inches to about 16 inches; more preferably from about 10 to about 12 inches. The diameter or width of bucket base 11 may range from about 6 inches to about 36 inches. Preferably the diameter or width of bucket base 11 ranges from about 7 to about 14 inches; and more preferably from about 10 to about 12 inches.

According the embodiments of FIGS. 1A–1F, cup compartment 20 has a smaller capacity, is narrower, and shallower than main compartment 16. Preferably cup compartment 20 has dimensions suitable for holding a paint brush in an upright position or at an angle of about at least 45 degrees from the horizontal or base 21 (FIG. 1C) of cup 20. Preferably cup 20 has a width ranging from about 3" to about 9". More preferably, cup 20 has a width of approximately 5 inches. Preferably cup 20 has a height of from about 3 inches to about 7 inches.

Figure 1B:
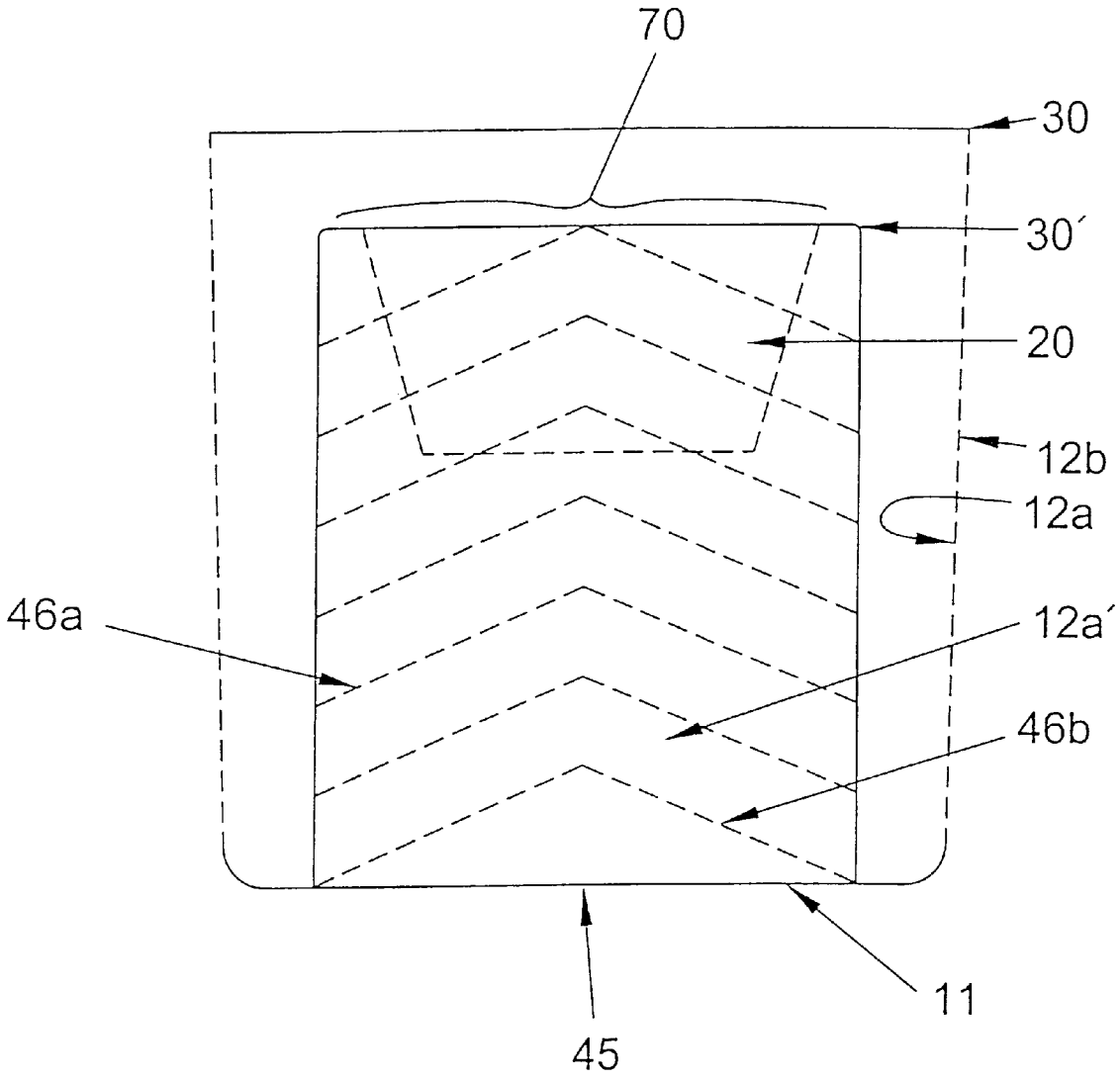
FIG. 1B is a sectional view of a bucket along line 1B—1B of FIG. 1A.
Figure 1C:
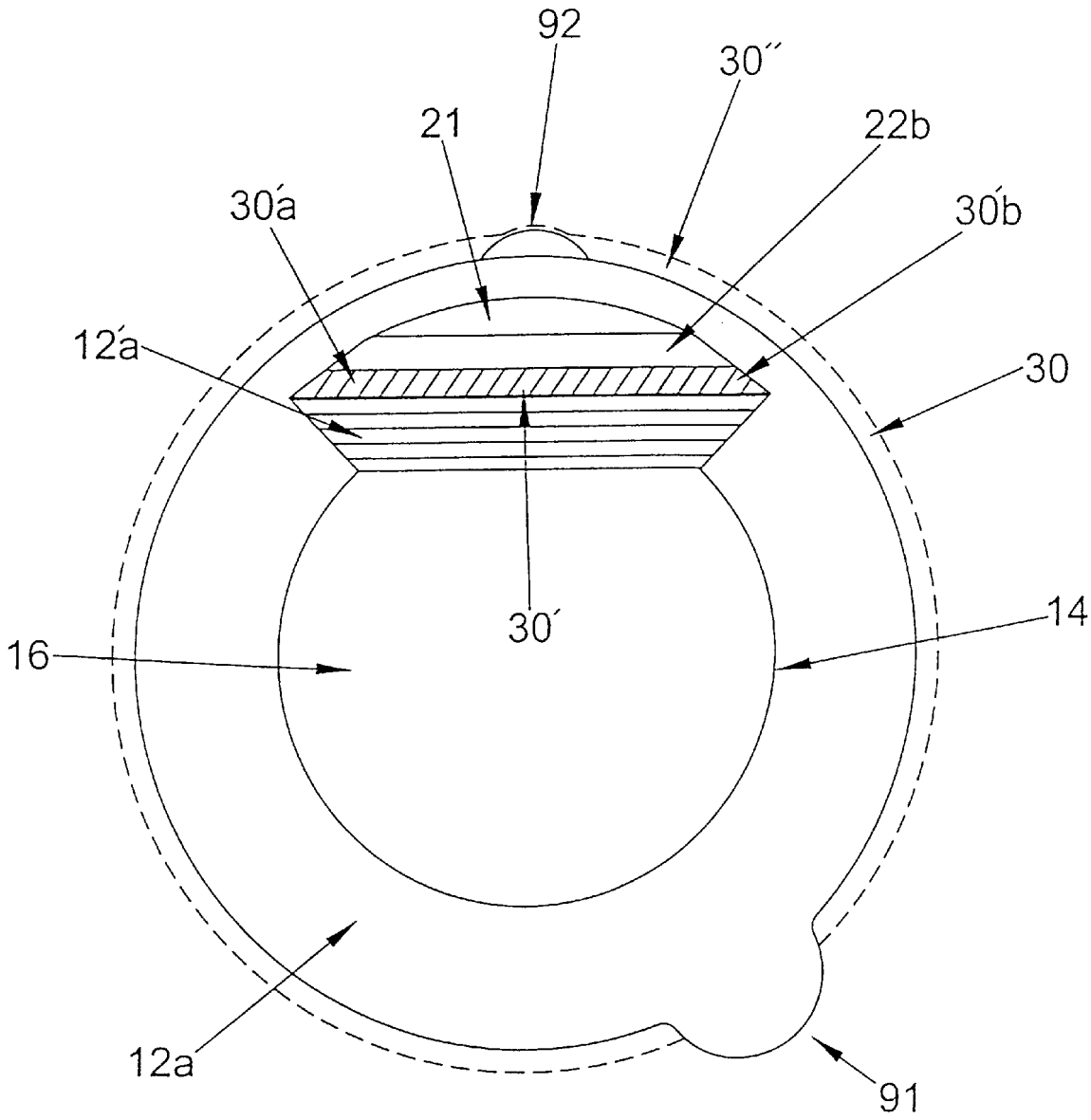
FIG. 1C shows a plan view of the bucket illustrated in FIG. 1A.
Figure 1D:
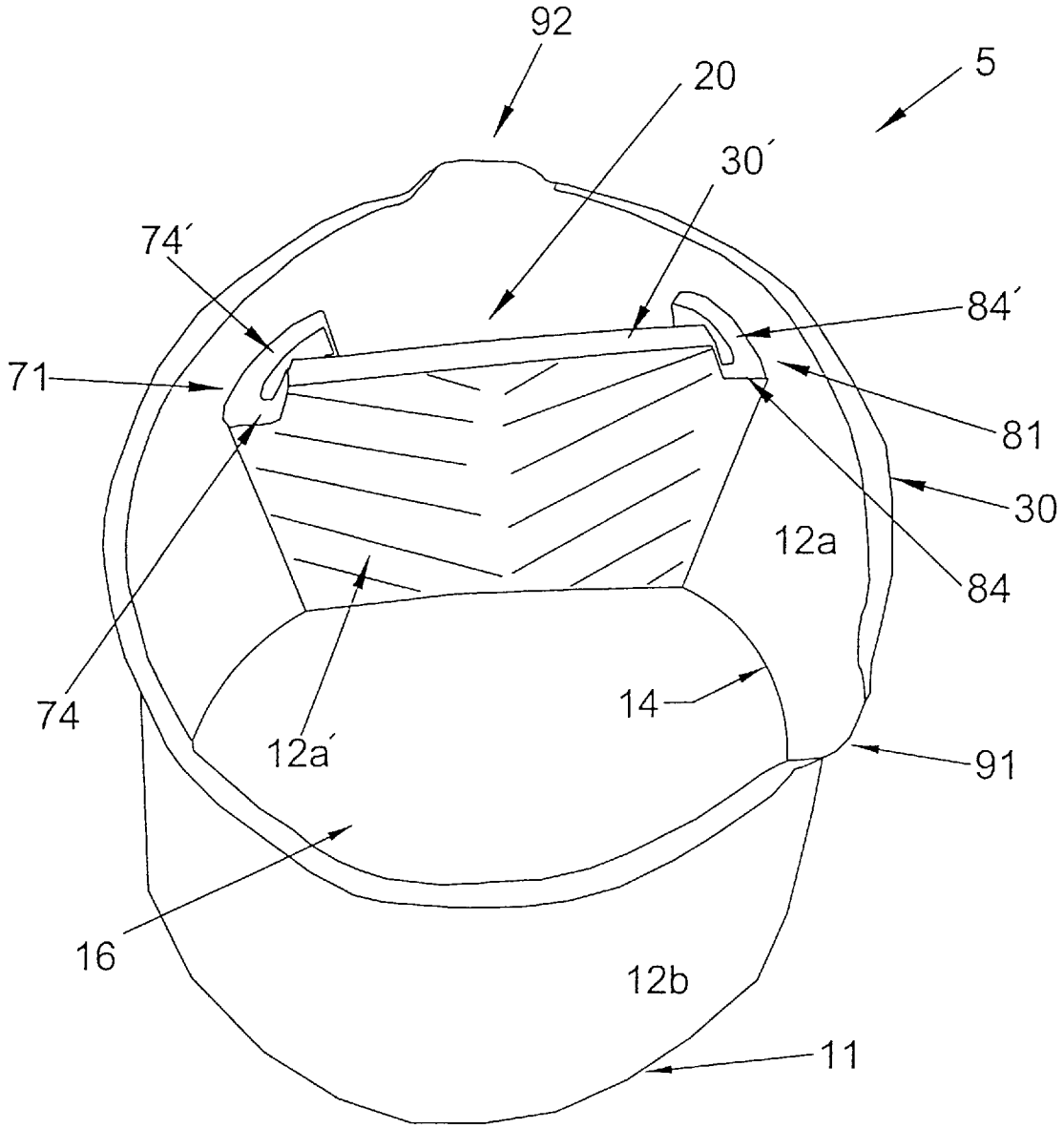
FIG. 1D is a perspective view from above of a bucket according to another embodiment of the invention, in which the bucket has no internal walls, the cup compartment is external to the bucket outer side, and a pair of channels are located on the straight section rim.

FIG. 1B is a sectional view of a bucket according to FIG. 1A as seen along line 1B—1B of FIG. 1A, and shows the relative position of bucket inner side straight section 12*a*' with respect to bucket inner side 12*a* and bucket outer side 12*b*. FIG. 1B also shows the relative height of straight section rim 30' and bucket rim 30. According to FIG. 1B, channel 70 runs the entire length of bucket inner side straight section 12*a*'. The relative position of cup 20 with respect to bucket inner side straight section 12*a*' is also shown. Bucket inner side straight section 12*a*' defines and provides a substantially planar or flat surface, and is of suitable size and shape for accommodating a paint roller. According to one embodiment of the invention, bucket inner side straight section 12*a*'is about 10 inches to about 11 inches wide and is suited to accommodating a standard 9 inch paint roller. A plurality of left indentations 46*a*, and right indentations 46*b* may be provided on the left and right sides, respectively, of bucket inner side straight section 12*a*'. Each left indentation 46*a* converges with a corresponding right indentation 46*b* at the midpoint of bucket inner side straight section 12*a*', the midpoint being drawn as line 45 in FIG. 1B. Left indentations 46*a* are substantially parallel to each other, as are right indentations 46*b*. Each left indentation 46*a* and right indentation 46*b* slopes downwards from midpoint 45 towards base 11. The angle at which left and right indentations 46*a*, 46*b* slope downwards may range from about 10° to about 16°; more preferably from about 12° to about 15°; and most preferably the angle is about 13.5°.

Figure 2A:
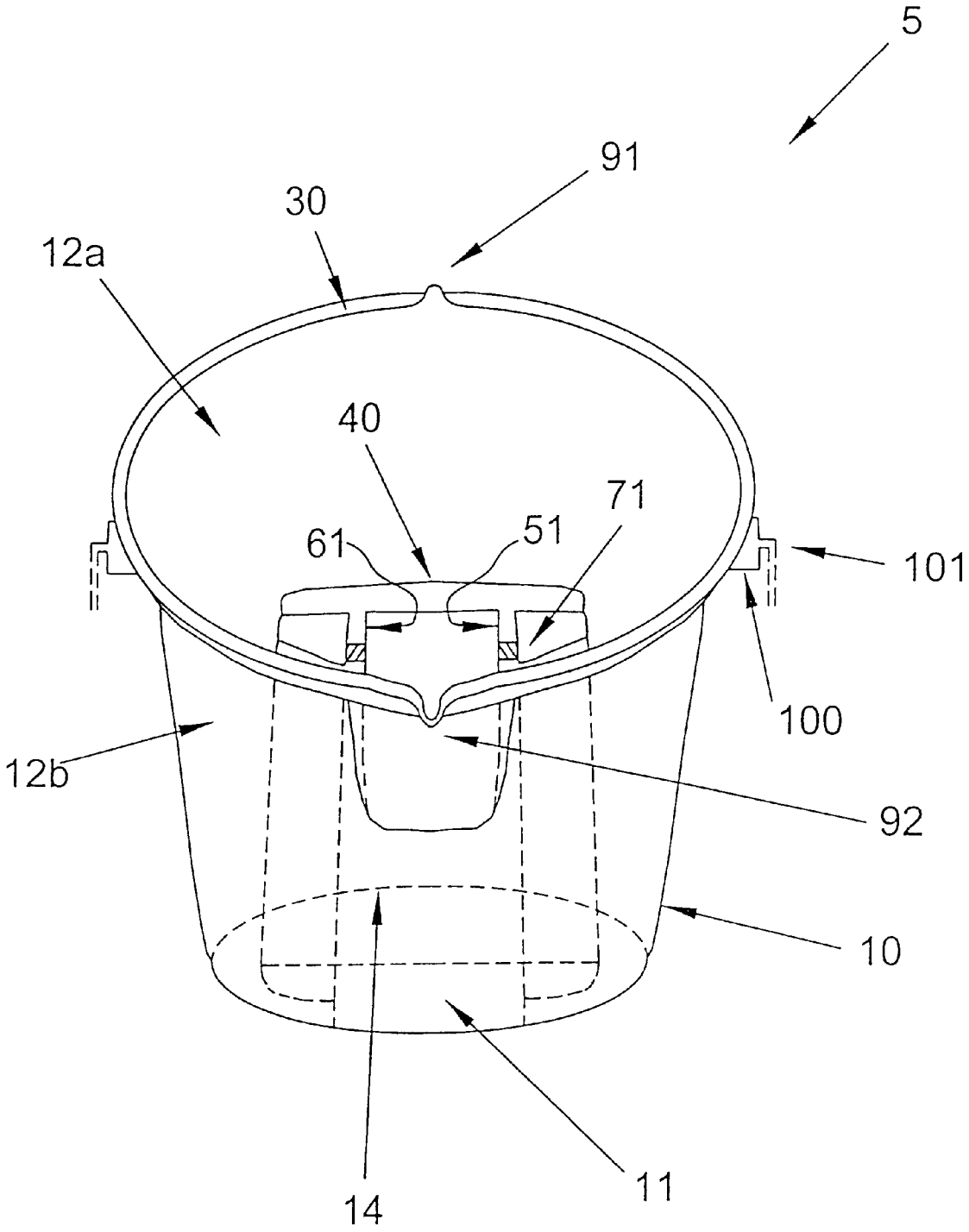
FIG. 2A is a perspective view of a bucket according to one embodiment of the invention.
Figure 2B:
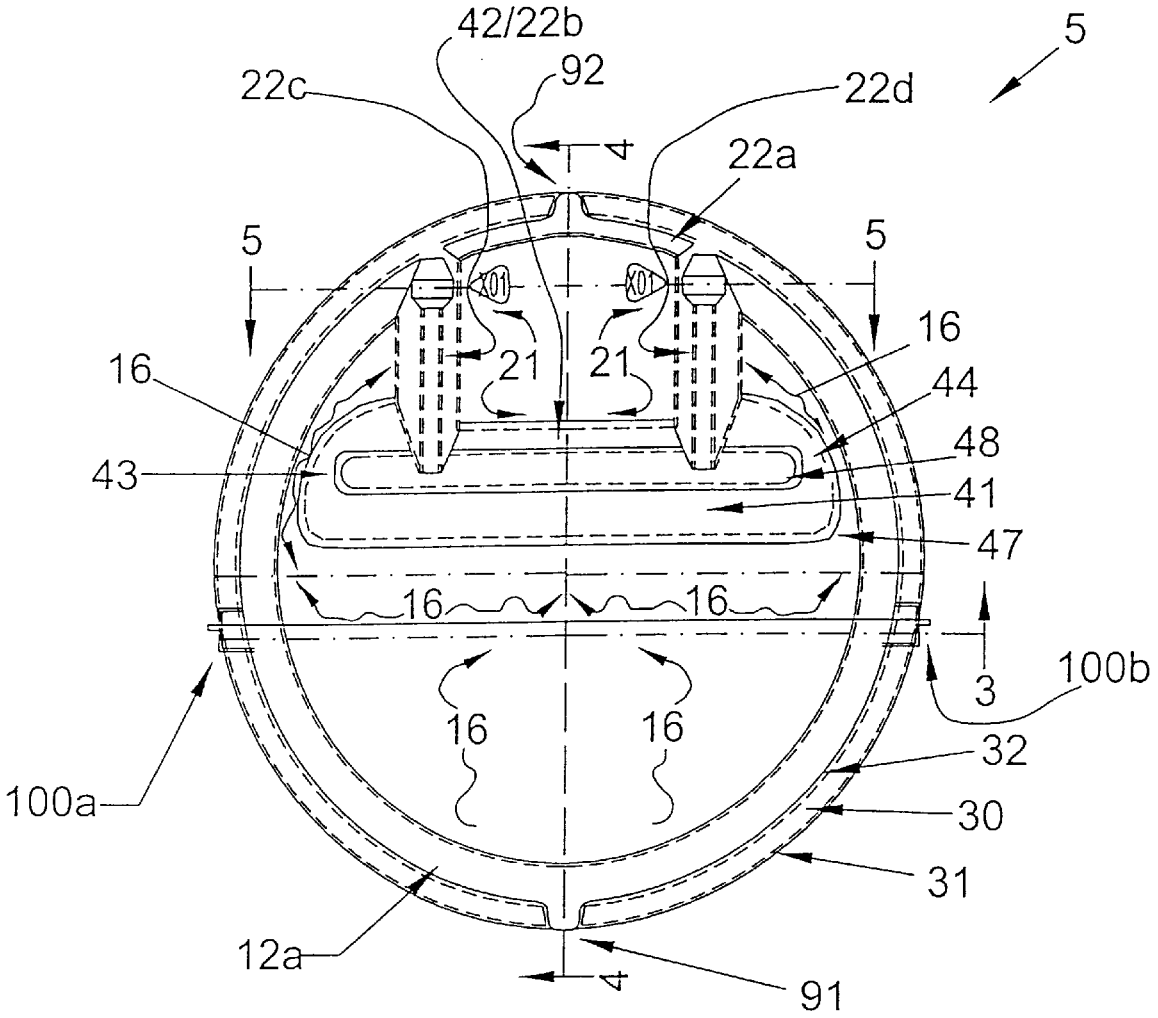
FIG. 2B is a plan view of the bucket shown in FIG. 2A.

Bucket inner side straight section 12*a*' may serve as a surface for applying and distributing a liquid such as paint, contained in main compartment 16, to a paint roller. That is to say, bucket inner side straight section 12*a*' may serve a dual role; both as a side of main compartment 16, and as a surface for applying/distributing paint or other materials to a paint roller or the like. In which case, the purpose of left and right indentations 46*a*, 46*b* is then to promote drainage of the liquid from bucket inner side straight section 12*a*' to main compartment 16. In this embodiment of the invention, bucket inner side straight section 12*a*' is, in part, functionally analogous to main wall inner side 41 (FIG. 2B). The spacing between each of left and right indentations 46*a*, 46*b* may range from several inches to a few mm. Preferably the spacing between each of left and right indentations 46*a*, 46*b* ranges from about 5 to about 0.5 inches; more preferably from about 3 to about 0.5 inch; and most preferably about 0.94 inches.

FIG. 1C shows a plan view of the bucket or pail 5 of FIG. 1A. In describing buckets according to various embodiments of the invention, the bucket as seen in plan view may be considered as being oriented such that second pouring spout 92 faces due North or at the 12 o'clock (twelve o'clock) position. In addition, the 9 o'clock and 3 o'clock positions will be considered to represent the left hand side and the right hand side of the bucket, respectively. Throughout this description of bucket 5, the term "inner" refers to that which is relatively close to the inside or center of the bucket, and the term "outer" refers to that which is relatively close to the outside of the bucket, as seen in plan view. FIG. 1C shows the relative positions of the bucket components according to one embodiment of the invention. Main compartment 16 is bounded by bucket inner side 12*a* and bucket inner side straight section 12*a*'. Bucket 5 includes bucket rim 30, straight section rim 30', and cup rim 30". Bucket rim 30 and cup rim 30" are substantially crescent shaped, while straight section rim 30' is substantially straight. Straight section rim 30' includes left edge of straight section rim 30'*a* and right edge of straight section rim 30'*b*. Second pouring spout 92 is located at the 12 o'clock position and is for pouring liquids from cup compartment 20; while first pouring spout 91 is for decanting or pouring liquids from main compartment 16. Although first pouring spout 91 is shown in FIG. 1C as being at approximately the 5 o'clock position, according to the invention, other locations for first pouring spout 91 on bucket rim 30 are possible.

FIG. 1D is a perspective view from above of a bucket according to another embodiment of the invention, in which bucket 5 includes a main compartment 16, a cup or cup compartment 20, a bucket base 11, a bucket rim 30, a bucket inner side 12*a*, a bucket outer side 12*b*, and a bucket inner basal edge 14. Bucket 5 further includes a bucket inner side straight section 12*a*' (and a corresponding bucket outer side straight section 12*b*'). Bucket inner side straight section 12*a*' includes a straight section rim 30'. Left and right channels, respectively 71 and 81, are formed in straight section rim 30' at left edge of straight section rim 30'*a* and right edge of straight section rim 30'*b*, respectively (FIG. 1C). Left and right channels 71/81 have left and right channel bases 74 and 84, respectively. Left and right channel bases 74 and 84 may each extend, to a greater or lesser extent, along bucket inner side 12*a* towards cup 20, to form left and right channel base extensions 74'/84'. Left and right channel bases 74 and 84 are each lower than straight section rim 30', which in turn is lower than bucket rim 30, thereby allowing for the facile transfer of liquid from main compartment 16 to cup 20. Left and right channel base extensions 74'/84' may be at the same height from bucket base 11 as left and right channel bases 74/84, or left and right channel base extensions 74'/84' may slope downwards towards bucket base 11 as they extend towards cup 20. In the latter case, drainage of liquids from left and right channel base extensions 74'/84' to cup 20 is facilitated.

Figure 1E:
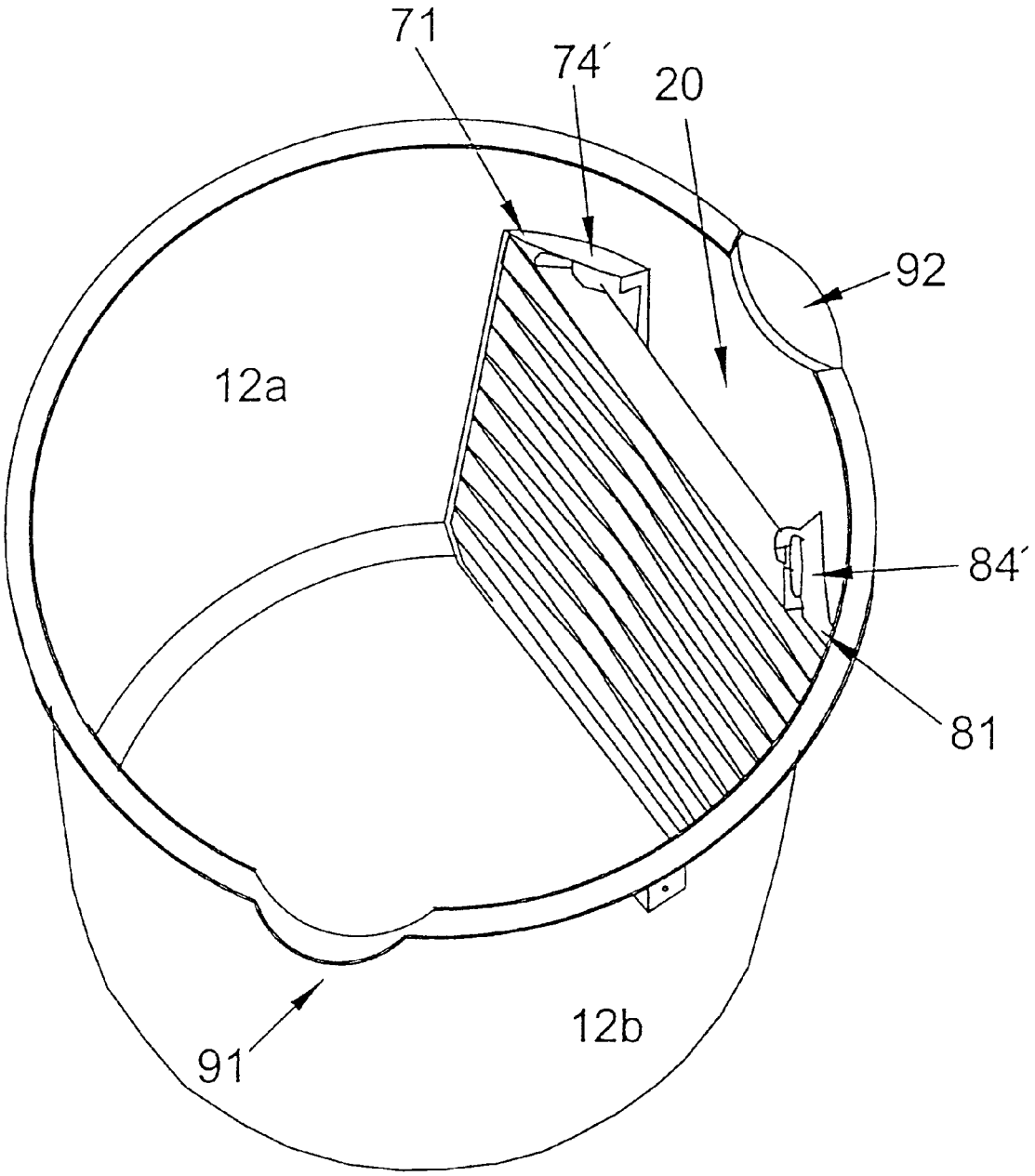
FIG. 1E is a different perspective view from above of the bucket shown in FIG. 1D.
Figure 1F:
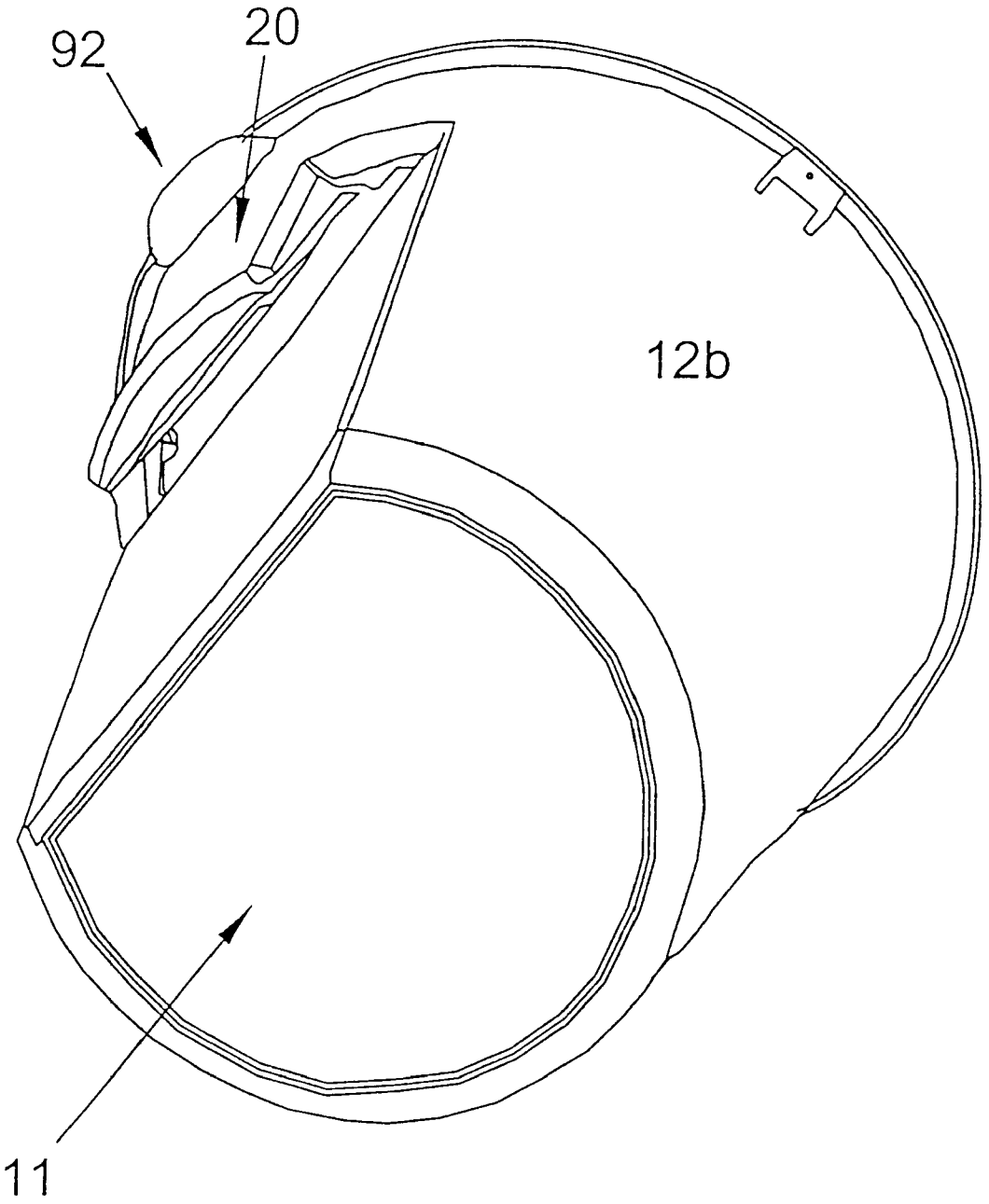
FIG. 1F is a perspective view from below of the bucket shown in FIG. 1D.

FIG. 1E shows a different perspective view from above of the bucket described above in relation to FIG. 1D, and shows the relative location of left and right channels 71/81, as well as first and second pouring lips 91/92 which are oriented approximately 120 degrees from each other. FIG. 1F is a perspective view from below of the bucket shown in FIGS. 1D and 1E, and illustrates the shape of bucket base 11, according to a preferred embodiment of the invention. Cup 20 is external to bucket outer side 12*b* and abuts from body 10 below second pouring lip 92. Other than functioning to contain a relatively small volume of liquid and/or a paint brush or the like, cup 20 may function in addition as a type of handle. For example cup 20 may be grasped by the hand of a worker as a way of holding or manipulating bucket 5, or bucket 5 may be suspended via cup 20 from an inanimate object, such as a ladder rung.

Figure 1G:
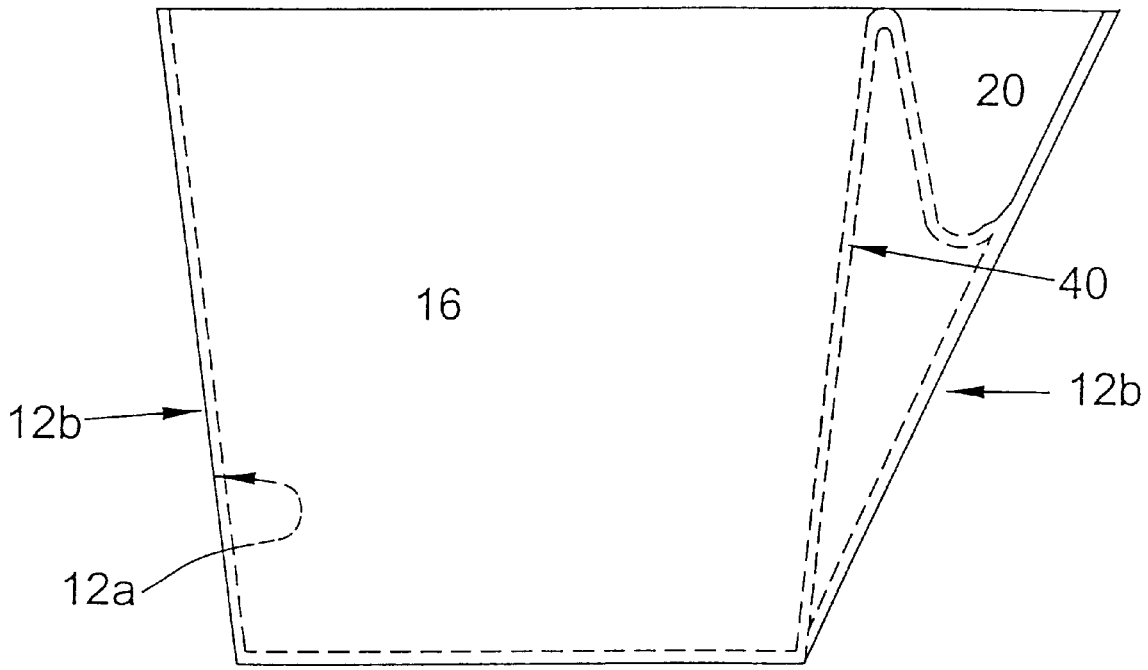
FIG. 1G shows a cross-section of a bucket according to another embodiment of the invention in which the bucket includes an internal wall and the cup compartment is internal to the bucket outer side.

FIG. 1G shows a cross-section of a bucket 5 according to another embodiment of the invention in which bucket 5 includes an internal wall, namely main wall 40, and cup compartment 20 is internal to bucket outer side 12*b*. Main compartment 16 is bounded by bucket inner side 12*a* and main wall 40. Main wall 40 provides a substantially planar surface suitable for distributing paint on a paint roller.

Figure 1H:
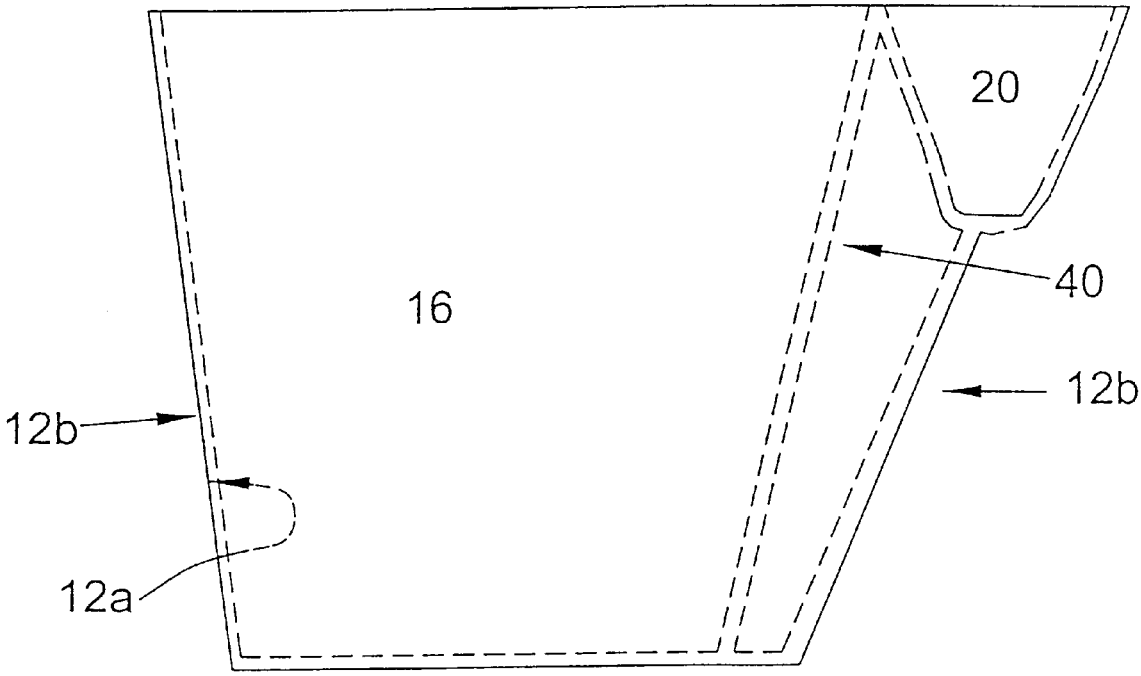
FIG. 1H shows a cross-section of a bucket according to another embodiment of the invention in which the bucket includes an internal wall and in which the cup compartment is partially internal and partially external to the bucket outer side.

FIG. 1H shows a cross-section of a bucket 5 according to another embodiment of the invention in which bucket 5 includes an internal wall, namely main wall 40, while cup compartment 20 occupies a position somewhat intermediate between a position internal to bucket outer side 12*b* (FIG. 1G) and external to bucket outer side 12*b* (FIG. 1A), i.e. cup compartment 20 may be partially internal to and partially external to bucket outer side 12*b*. In the embodiment of FIG. 1H cup compartment 20 may protrude, to a greater or lesser extent, from bucket outer side 12*b*. According to one embodiment, cup 20 may protrude from inner/outer sides 12*a*/12*b*, at a point below second pouring spout 92, to a distance ranging from about 2 to about 4 inches. Once again, in the embodiment of FIG. 1H main wall 40 helps to define main compartment 16, and at the same time provides a substantially planar surface suitable for distributing paint on a paint roller.

According to one embodiment of the invention, bucket 5 includes at least one internal walls, i.e. walls that are internal to body 10 or within bucket inner side 12*a*. Internal walls of bucket 5 may be straight or variously curved. FIG. 2A shows a bucket according to one embodiment of the invention, wherein bucket 5 has as internal walls a main wall 40, and left (or first) and right (or second) tangential walls 51 and 61, respectively (FIGS. 2A, 2E).

Bucket 5, including main compartment 16 and cup compartment 20, may be made or formed as a unit from any suitable water-tight or liquid-proof materials, such as various metallic materials such as sheet metal or aluminum foil which is formed or drawn. Alternatively, bucket 5 may be formed from various polymeric or plastic materials, e.g. polyurethane, or polyethylene. Preferably, bucket 5 including integral cup compartment 20 may be conveniently made by a molding process from, e.g. high density polyethylene (HDPE), as will be described hereinbelow.

The relative positions of the bucket components internal to bucket inner side 12*a*, according to one embodiment of the invention, can be seen in FIG. 2B. Bucket rim 30 is approximately circular in shape and includes outer rim 32 and inner rim 31. Inner rim 31 leads to first pouring spout 91 and second pouring spout 92 which are located diametrically opposite each other at the 6 o'clock and 12 o'clock positions of bucket rim 30, as shown in FIG. 2B. According to embodiments of bucket 5 as described herein, first pouring spout 91 is for decanting or pouring liquids from main compartment 16, while second pouring spout 92 is for pouring liquids from cup compartment 20. In one sense, main compartment 16 may be defined as that internal part of bucket 5 for containing a liquid other than cup 20. The upper part of cup 20 on each side of second pouring spout 92 terminates at the front part of bucket rim 30.

A main wall 40 lies in an East-West orientation from about 10 o'clock to about 2 o'clock and includes a main wall top 48 the height of which may be flush with bucket rim 30 of bucket 5. Main wall 40, including main wall outer side 42 and main wall top 48, is preferably entire or unbroken, i.e. there are no channels or other types of interruptions within main wall 40. Main wall 40 provides a substantially planar surface suitable for distributing paint on a paint roller.

Main wall 40 further includes a basal perimeter 47 having an inner basal perimeter 47*a* and an outer basal perimeter 47*b*. According to FIG. 2B, left and right tangential, or joining, walls 51 and 61, respectively, each form a tangent with inner side 12*a* at approximately the 11 o'clock and 1 o'clock positions, respectively, and each of left and right tangential walls 51 and 61 intersect main wall 40 at about a right angle. Thus, left and right tangential walls 51 and 61 are each contiguous with and abut against inner side 12*a* and main wall 40, and together with bucket inner side 12*a* and main wall outer side 42 form cup compartment or cup 20 adjacent to second pouring spout 92. Cup 20 is therefore integral with body 10 of bucket 5. The exact point and angle of contact of left and right tangential walls 51, 61 with main wall 40 and bucket inner side 12*a* may vary depending on the particular position, size, and shape required of cup compartment 20.

Figure 2C:
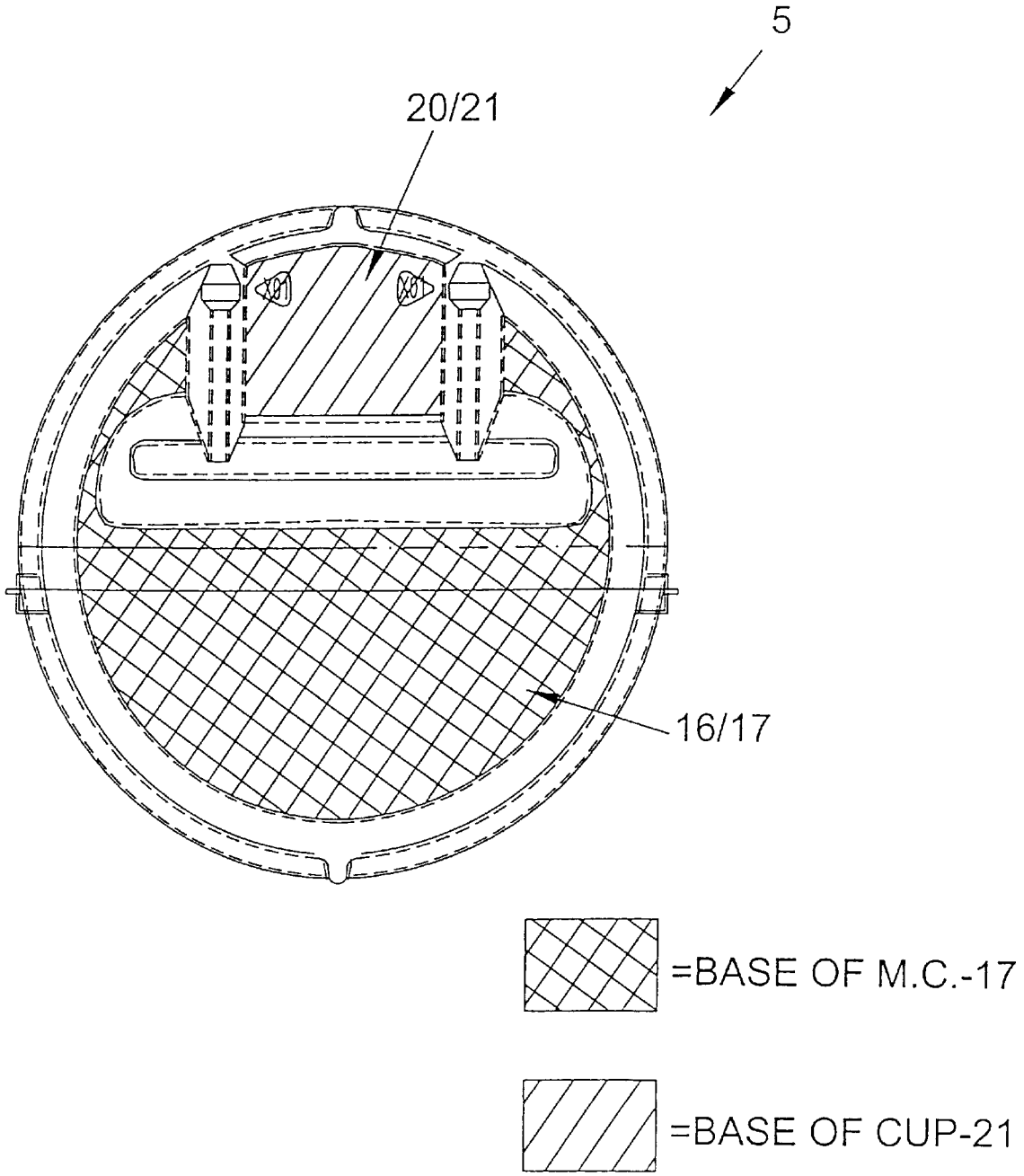
FIG. 2C is a plan view of a bucket in which the base of the main compartment is distinguished from the base of the cup compartment.

FIG. 2C is a plan view of a bucket which shows the distinction between the main compartment base 17 and the cup compartment base 21, according to one embodiment of the invention. FIG. 2C also indicates the relative location of main compartment 16 with respect to cup compartment 20. Main compartment base 17 may be contiguous with, or represent the obverse side of, bucket base 11 (see, e.g., FIG. 3). The surface area of main compartment base 17 is substantially greater than the surface area of cup compartment base 21. In fact, the ratio of the surface area of main compartment base 17 to the surface area of cup compartment base 21 is preferably from about 10:1 to about 3:1; more preferably from about 9:1 to about 4:1; and most preferably about 8:1.

Figure 2D:
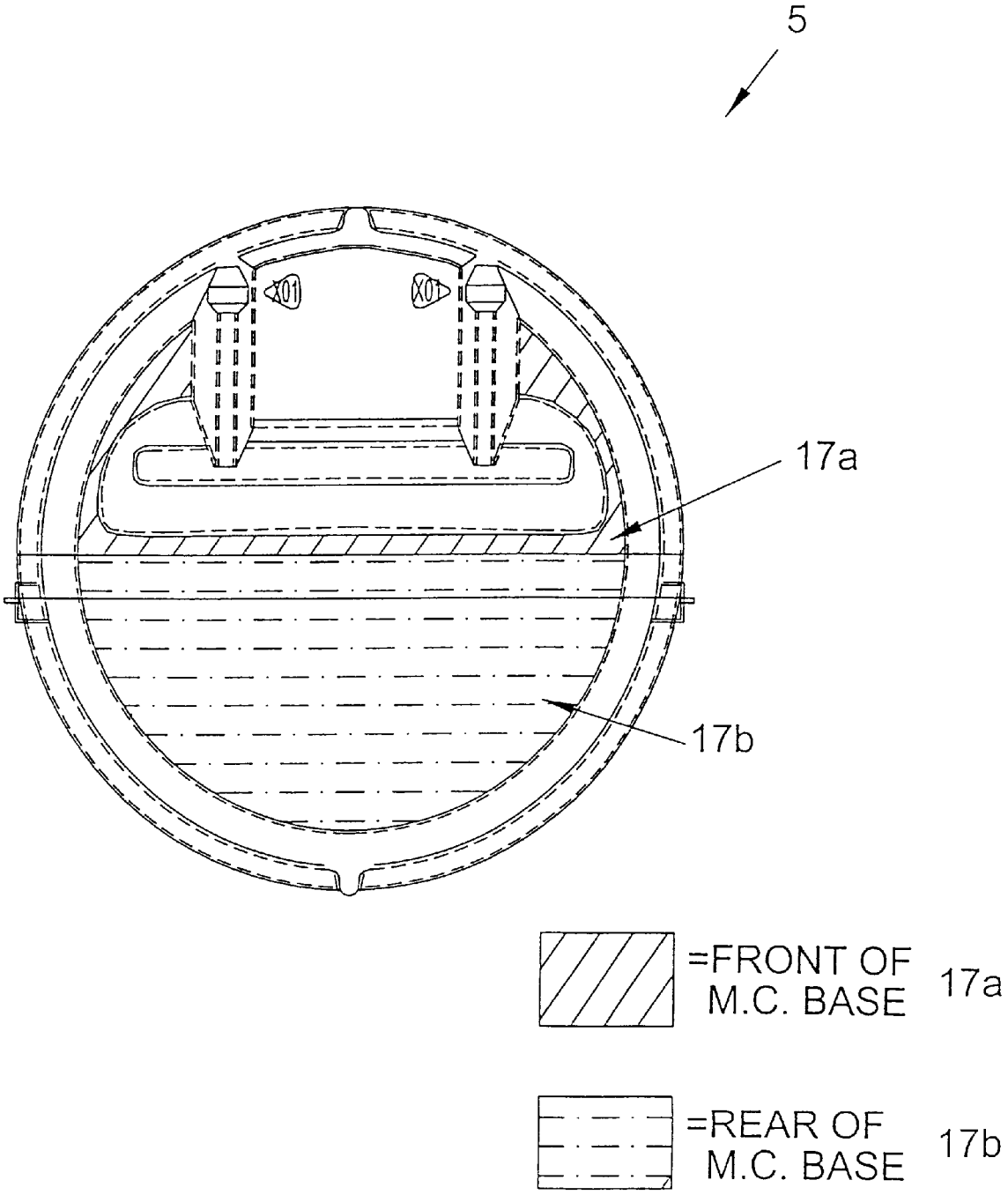
FIG. 2D is a plan view of a bucket which distinguishes the front portion of the main compartment base from the rear portion of the main compartment base, according to the invention.
Figure 2E:
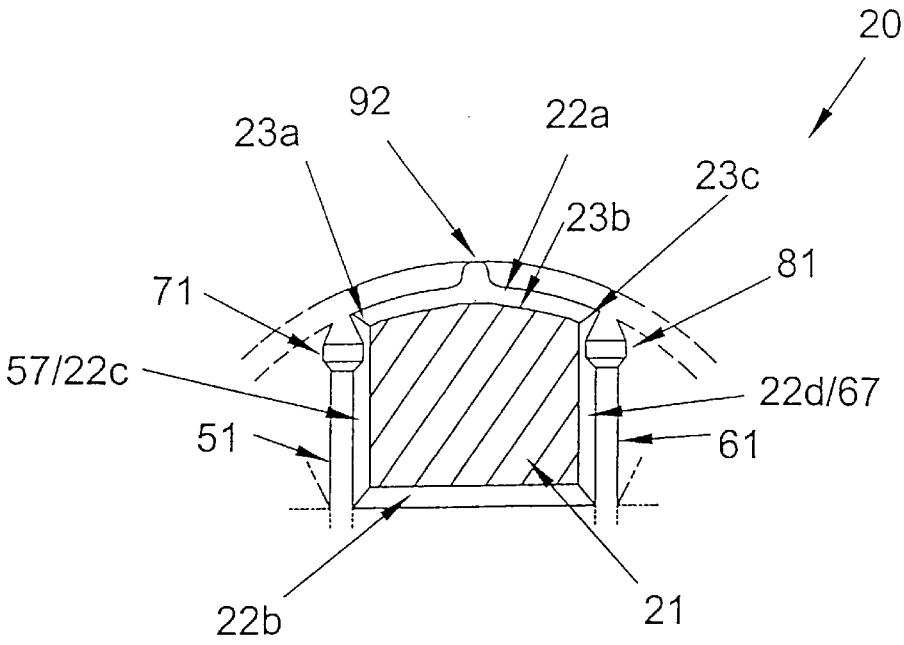
FIG. 2E is a plan view of a bucket showing details of the cup compartment.

FIG. 2D is a plan view of a bucket which distinguishes the front main compartment base 17*a* (of main compartment base 17) from the rear main compartment base 17*b* (of main compartment base 17), according to one embodiment of the invention. For the purposes of this discussion, front main compartment base 17*a* is that part of main compartment base 17 which extends above an imaginary diametric line drawn across the bucket between the 3 o'clock and 9 o'clock positions, and rear main compartment base 17*b* is the remaining portion of main compartment base 17. It can be seen that due to the presence of main wall 40, and in particular, due to the presence of basal perimeter 47 of main wall 40, the surface area of front main compartment base 17*a* is substantially less that the surface area of rear main compartment base 17*b*. As will be described fully hereinbelow, the ratio of the surface area of front main compartment base 17*a* to the surface area of rear main compartment base 17*b* is an important parameter in determining the manner and relative ease with which a liquid may be transferred from main compartment 16 to cup 20. Preferably the ratio of the surface area of front main compartment base 17*a* to the surface area of rear main compartment base 17*b* ranges from about 25:1 to about 4:1; and more preferably from about 20:1 to about 10:1.

Figure 2F:
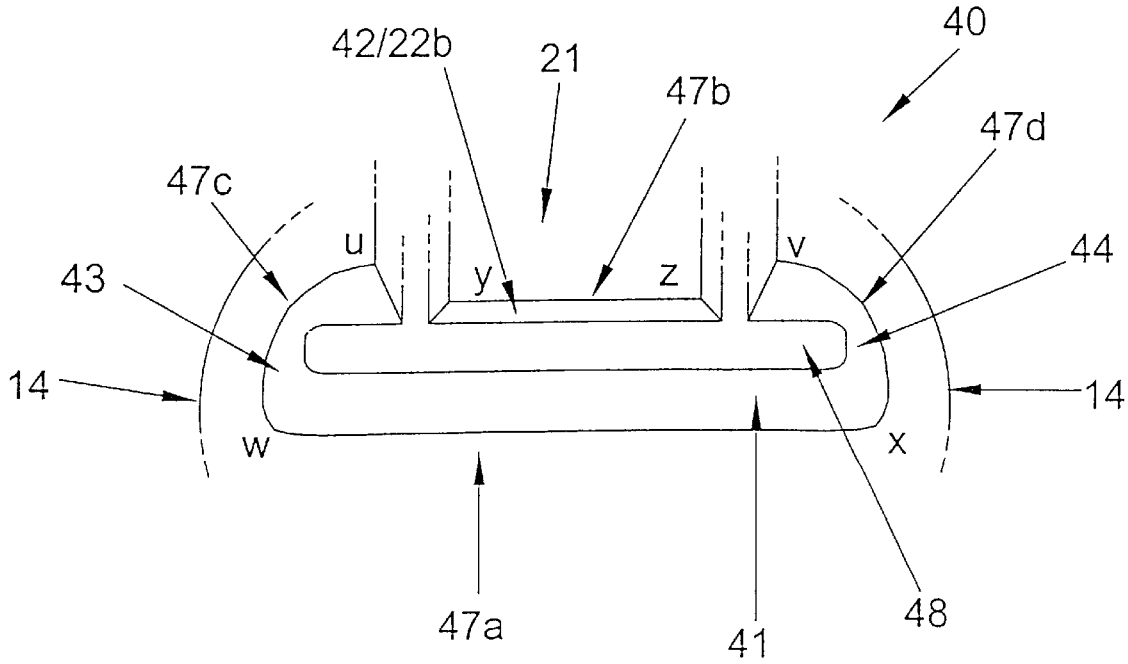
FIG. 2F is a plan view of a bucket showing details of the main wall; according to one embodiment of the invention.

FIG. 2E is a plan view of bucket 5 showing the details of cup or cup compartment 20, which lies symmetrically about second pouring spout 92. When bucket 5, and its integral cup 20, are tilted to a sufficient extent towards the 12 o'clock position, the contents of cup 20, if any, may be conveniently poured from pouring spout 92. Cup 20 has cup outer, inner, left and right sides, 22*a–d*, respectively, as well as cup base 21. Cup outer side 22*a* may be formed by bucket inner side 12*a*, or alternatively cup outer side 22*a* may protrude from bucket inner/outer sides 12*a*/12*b* at left, lower, and right cup outer edges 23*a,b,c*, respectively. Cup inner side 22*b* is formed by main wall outer side 42 (FIG. 2F). Cup left side 22*c* is formed by right side 57 of left (or first) tangential wall 51, and cup right side 22*d* is formed by right side 67 of right (or second) tangential wall 61.

The height of bucket rim 30 from cup base 21 may be considerably less than the height of bucket rim 30 from main compartment base 17. Indeed, the ratio of the height of bucket rim 30 from main compartment base 17 to the height of bucket rim 30 from cup base 21 may range from 10:9 to 10:1. According to one embodiment of the invention, the preferred ratio of the height of bucket rim 30 from main compartment base 17 to the height of bucket rim 30 from cup base 21 is 10:6.

One feature of bucket 5 according to the invention is that the surface area of cup base 21 may be considerably less than the surface area of main compartment base 17. According to the invention, the ratio of the surface area of main compartment base 17 to the surface area of cup base 21 may range from 10:8 to 25:1. According to one embodiment of the invention, the preferred ratio of the surface area of main compartment base 17 to the surface area of cup base 21 is 12:1.

FIG. 2F is a plan view of bucket 5 showing details of main wall 40, according to one embodiment of the invention. Main wall 40 includes main wall inner side 41, main wall outer side 42, left rounded edge 43, right rounded edge 44, main wall top 48, and main wall basal perimeter 47. Main wall outer side 42 includes cup inner side 22*b*. Main wall basal perimeter 47 includes inner basal perimeter 47*a*, outer basal perimeter 47*b*, left basal perimeter 47*c*, and right basal perimeter 47*d*. Inner basal perimeter 47*a* and outer basal perimeter 47*b* are represented by substantially parallel lines shown in FIG. 2F as W-X and Y-Z, respectively. Left basal perimeter 47*c*, and right basal perimeter 47*d* are represented by curved or arcuate lines shown in FIG. 2F as W-U and X-V, respectively.

Main wall basal perimeter 47 is contiguous with main compartment base 17. Main wall top 48 has a main wall top perimeter 49 which is substantially rectangular in shape. Main wall top perimeter 49 is substantially less than main wall basal perimeter 47, and main wall 40 may assume an overall wedge-like shape. The relatively large size of main wall basal perimeter 47 accounts for the relatively small surface area of front main compartment base 17*a* as compared with the surface area of rear main compartment base 17*b*. As alluded to hereinabove, the ratio of the surface area of front main compartment base 17*a* to the surface area of rear main compartment base 17*b* is an important parameter of bucket 5, according to the invention. Specifically, the ratio of the surface area of front main compartment base 17*a* to the surface area of rear main compartment base 17*b* is an important parameter in determining the manner in which a liquid may be transferred between main compartment 16 and cup compartment 20. Thus, for a bucket having a main compartment base of a given surface area, the size of main wall basal perimeter 47 is itself an important parameter of bucket 5, according to the invention. Preferably, the ratio of the surface area occupied within main wall basal perimeter 47 to the surface area of front main compartment base 17*a* is from about 10:1to about 1:1; more preferably from about 7:1 to about 2:1; and most preferably about 4:1.

Figure 3:
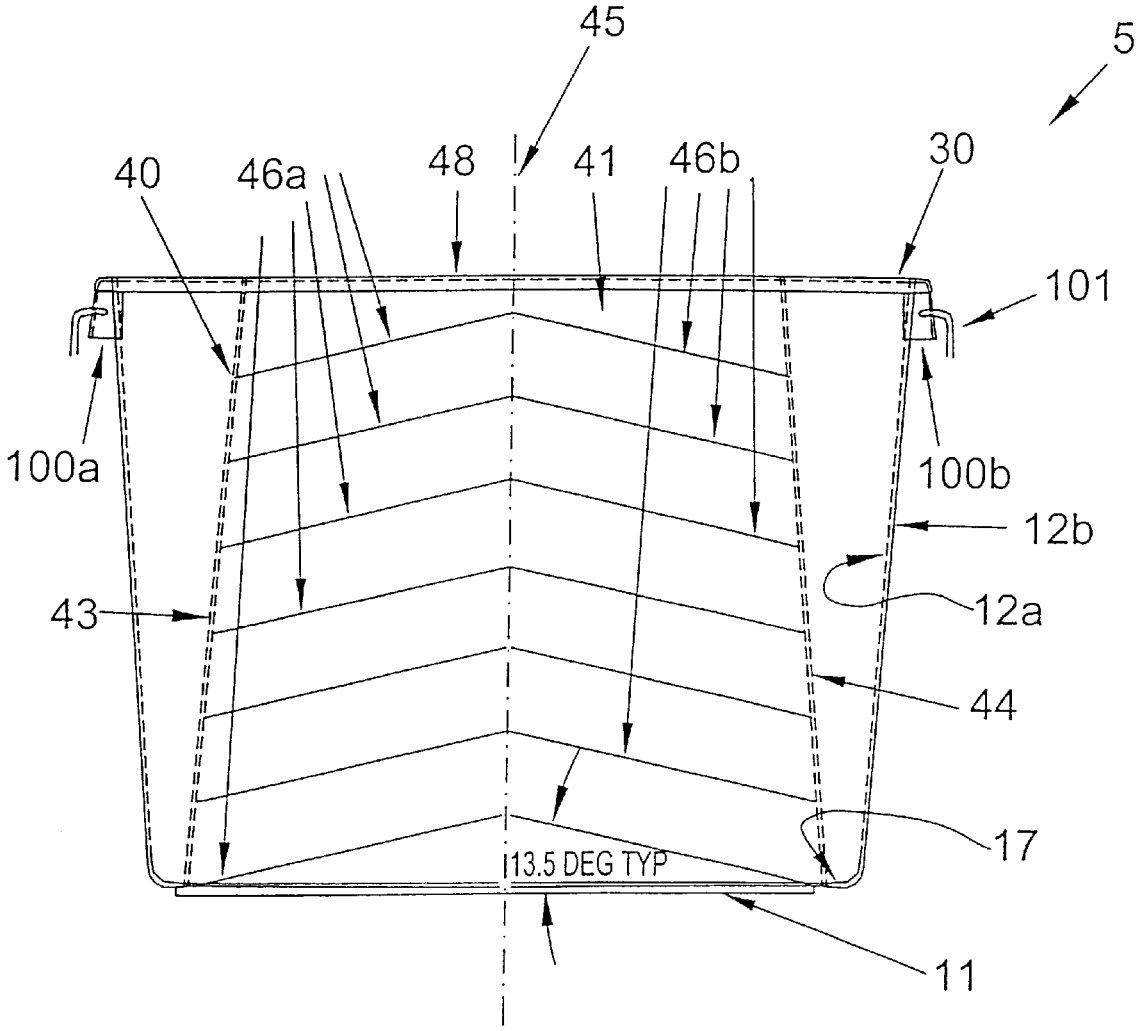
FIG. 3 is a vertical sectional view taken along the line 3—3 of FIG. 2B, according to one embodiment of the invention.

FIG. 3 is a vertical sectional view of bucket 5, taken along the line 3—3 of FIG. 2B, showing the relative location of main wall 40, and a frontal view of main wall inner side 41, according to one embodiment of the invention. Left and right rounded edges 43 and 44 each taper away from inner and outer bucket sides 12*a*, 12*b* towards main wall top 48. Bucket rim 30 is flush with main wall top 48 in the vertical plane, i.e. bucket rim 30 and main wall top 48 are of the same height or of substantially the same height. Main wall inner side 41 includes a plurality of left indentations 46*a*, and right indentations 46*b* on its left and right sides, respectively. Each left indentation 46*a* converges with a corresponding right indentation 46*b* at the main wall inner side mid-point, drawn as line 45 in FIG. 3. Left indentations 46*a* are substantially parallel to each other, as are right indentations 46*b*. Each left indentation 46*a* and right indentation 46*b* slopes downwards from midpoint 45 towards left and right rounded edges 43, 44, respectively. The angle at which left and right indentations 46*a*, 46*b* slope downwards may range from about 10° to about 16°; more preferably from about 12° to about 15°; and most preferably the angle is about 13.5°.

Main wall inner side 41 may serve as a surface for applying and distributing a liquid such as paint, contained in main compartment 16, to a paint roller. In this regard, main wall inner side 41 is functionally analogous to bucket inner side straight section 12*a*' (FIG. 1B). The purpose of left and right indentations 46*a*, 46*b* is then to promote drainage of the liquid from main wall inner side 41 to main compartment 16. The spacing between each of left and right indentations 46*a*, 46*b* may range from several inches to a few mm. Preferably the spacing between each of left and right indentations 46*a*, 46*b* ranges from about 5 to about 0.5 inches; more preferably from about 3 to about 1 inch; and most preferably about 0.94 inches.

Figure 4:
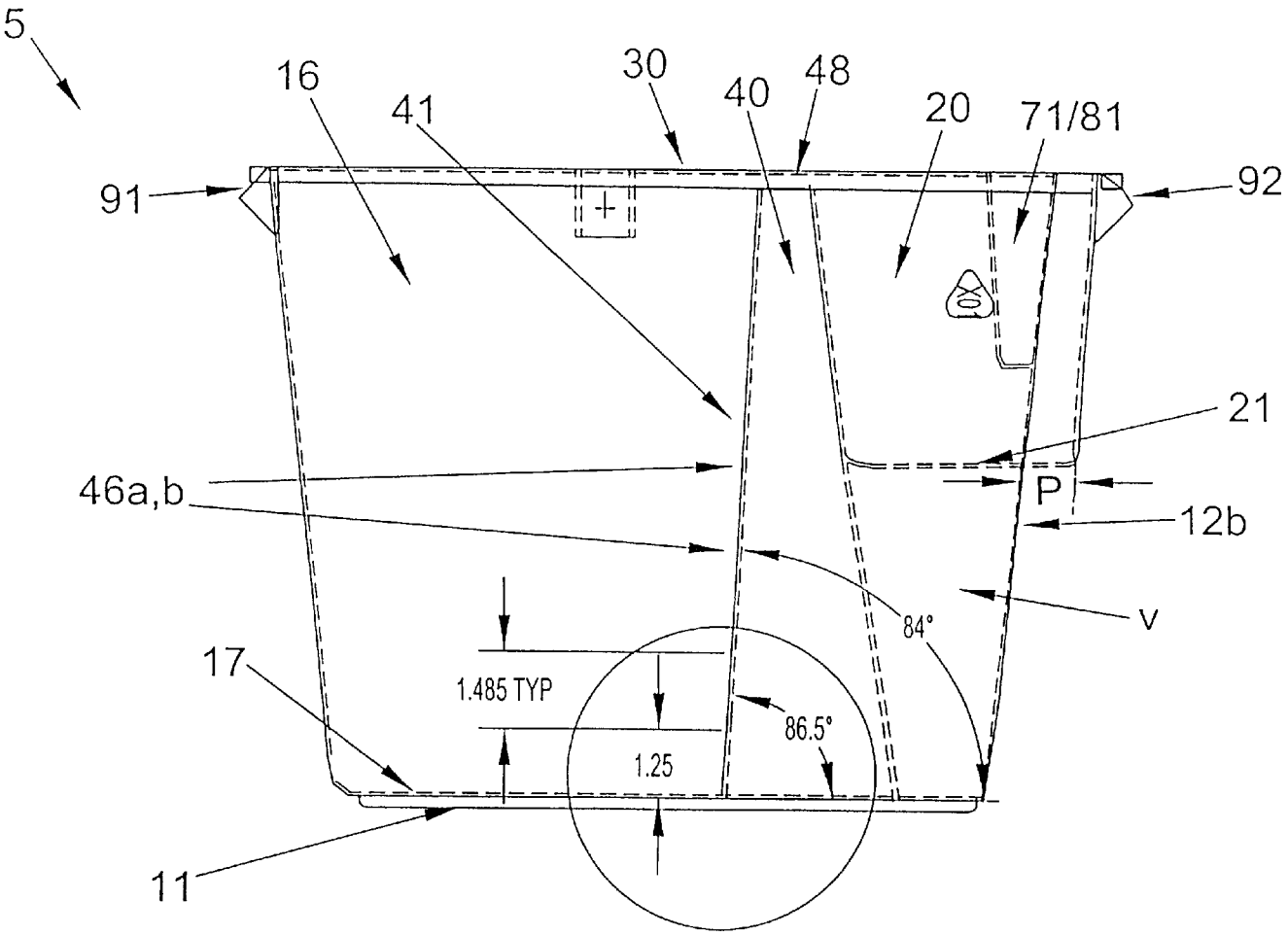
FIG. 4 is a vertical sectional view taken along the line 4—4 of FIG. 2B, according to one embodiment of the invention.

FIG. 4 is a vertical sectional view of bucket 5 taken along the line 4—4 of FIG. 2B, according to one embodiment of the invention. FIG. 4 shows first pouring spout 91, main compartment 16, main wall 40, cup compartment 20, left and right channels 71/81, and second pouring spout 92 in cross-section. Beneath cup 20 there is a void or dead space (labeled as V in FIG. 4) which is formed jointly by bucket inner side 12*a*, the underside of cup base 21, the lower part of main wall outer side 42, and the lower parts of left and right tangential walls 51, 61. Main wall inner side 41 may slope towards cup 20 to form an angle with bucket base 11 ranging from about 79–89°; more preferably main wall inner side 41 forms an angle with bucket base 11 ranging from about 82–86°; and most preferably main wall inner side 41 forms an angle with bucket base 11 of about 84°.

The front part of cup base 21, and concomitantly left and right tangential walls 51/61, may protrude from bucket inner and outer sides 12*a,b* to a distance P (FIG. 4). According to various embodiments of the invention, distance P may vary to a greater or lesser extent. Generally distance P ranges from 0 to about 6 inches; more preferably from 0.25 to 2 inches; and most preferably distance P is about 1.75 inches.

Left and right indentations 46*a,b* are shown in FIG. 4 as step-like indentations. However, other types of indentations or topographical patterns on main wall inner side 41 are possible according to the invention, provided such indentations promote drainage of liquid from main wall inner side 41 to main compartment 16.

Figure 5:
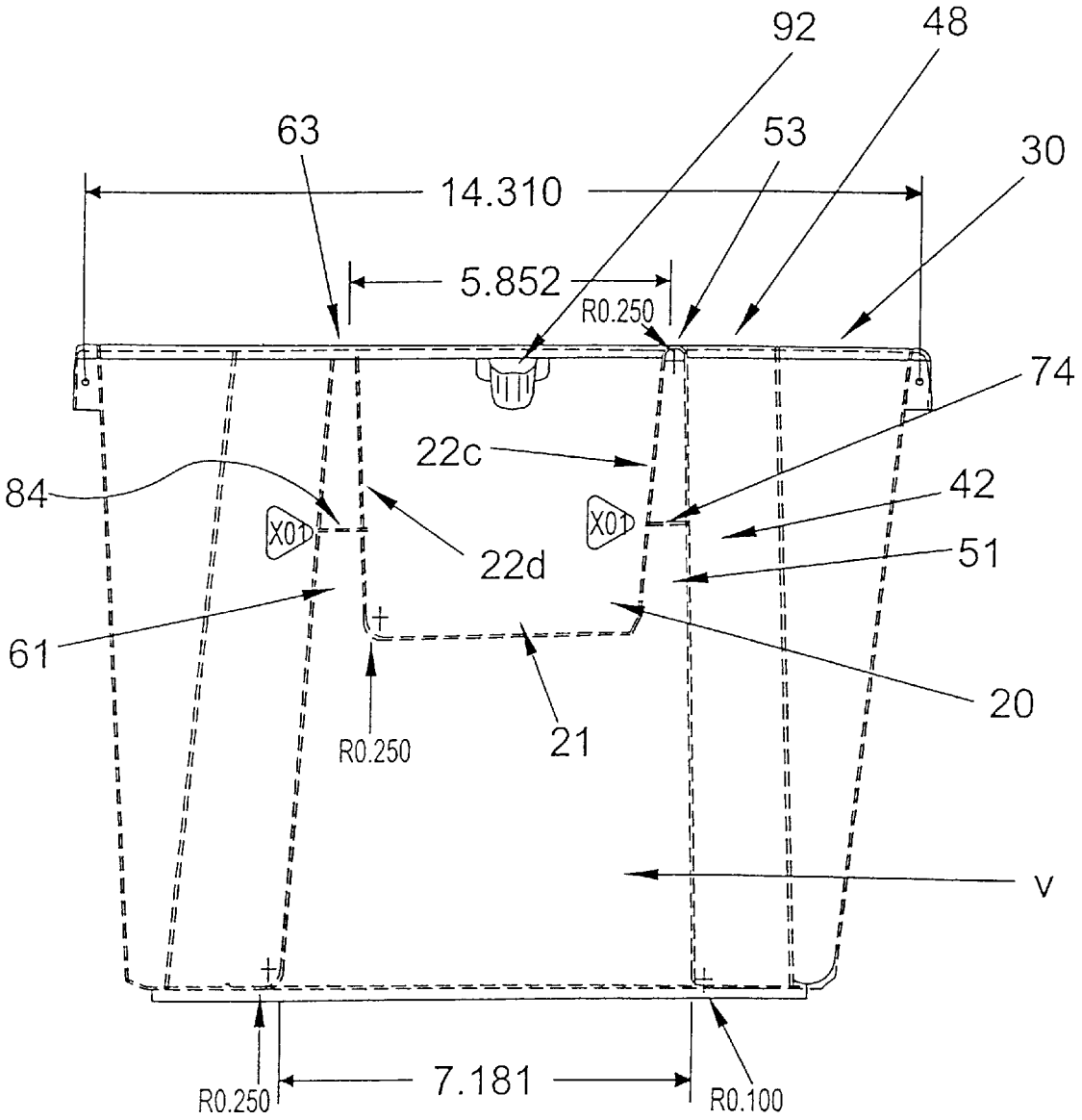
FIG. 5 is a vertical sectional view taken along the line 5—5 of FIG. 2B, according to one embodiment of the invention.

FIG. 5 is a vertical sectional view taken along the line 5—5 (FIG. 2B), according to one embodiment of the invention. FIG. 5 shows a frontal view of a vertical section of bucket 5, including second pouring spout 92, cup 20, main wall outer side 42, left and right tangential walls 51, 61, and left and right channel bases 74 and 84, respectively. (Note that as viewed from the front left and right tangential walls 51, 61 appear to the right and left of the drawing, respectively.) Cup 20 includes cup base 21, and left and right sides 22*c* and 22*d*, respectively. Also shown in FIG. 5 are bucket rim 30, main wall top 48, left tangential wall top 53 and right tangential wall top 63. In the particular embodiment shown in FIG. 5, bucket rim 30, main wall top 48, left tangential wall top 53 and right tangential wall top 63 all have the same height, or substantially the same height.

Figure 6:
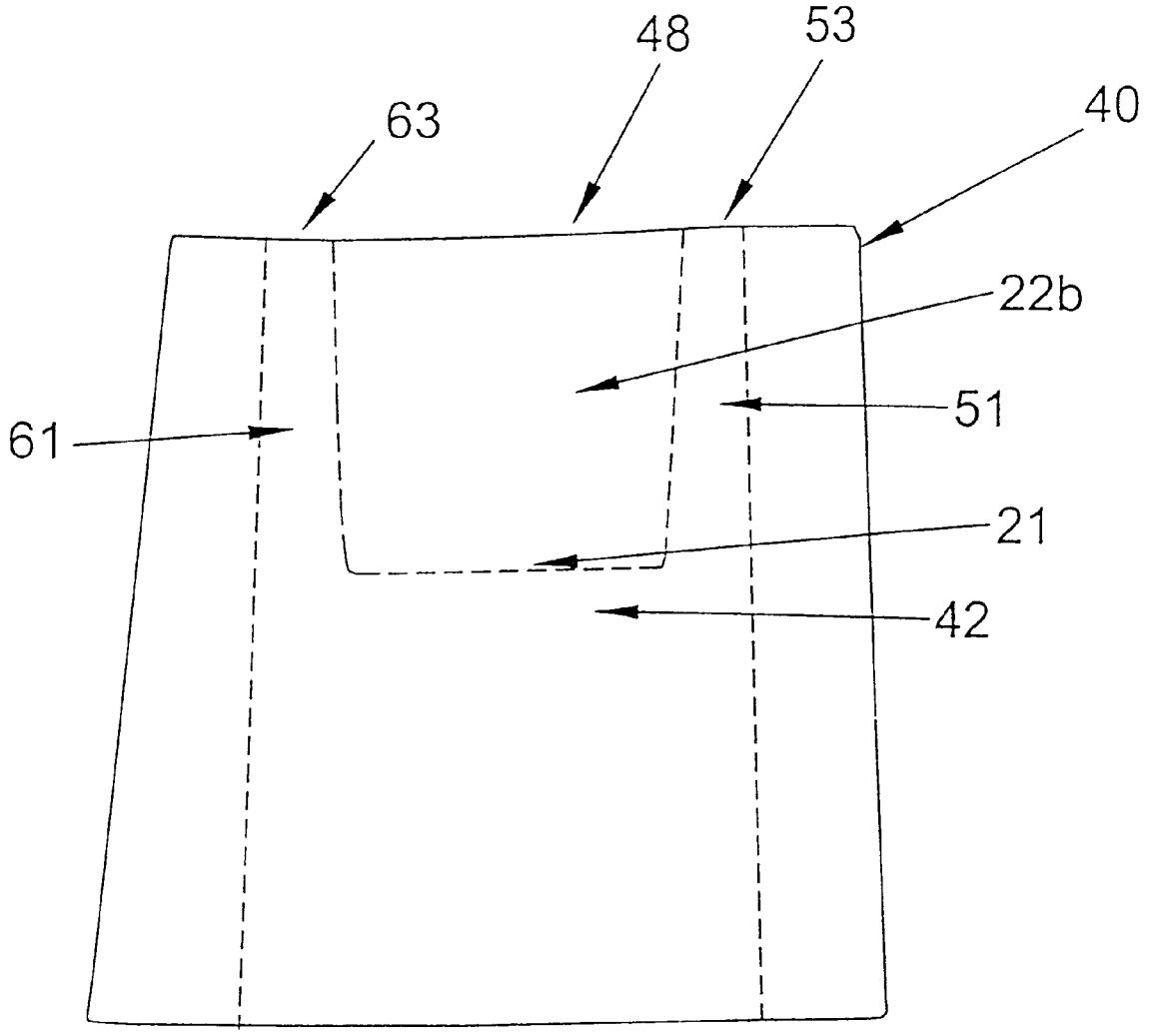
FIG. 6 is a frontal view of the main wall of a bucket showing the relative position of first and second tangential walls and the cup compartment, according to one embodiment of the invention.

FIG. 6 is a frontal view of bucket 5 according to one embodiment of the invention, with body 10 of bucket 5 removed for the sake of clarity, and showing inter alia main wall outer side 42. The relative position of left and right tangential walls 51, 61, with respect to main wall 40 and cup compartment 20 are clearly illustrated.

Figure 7:
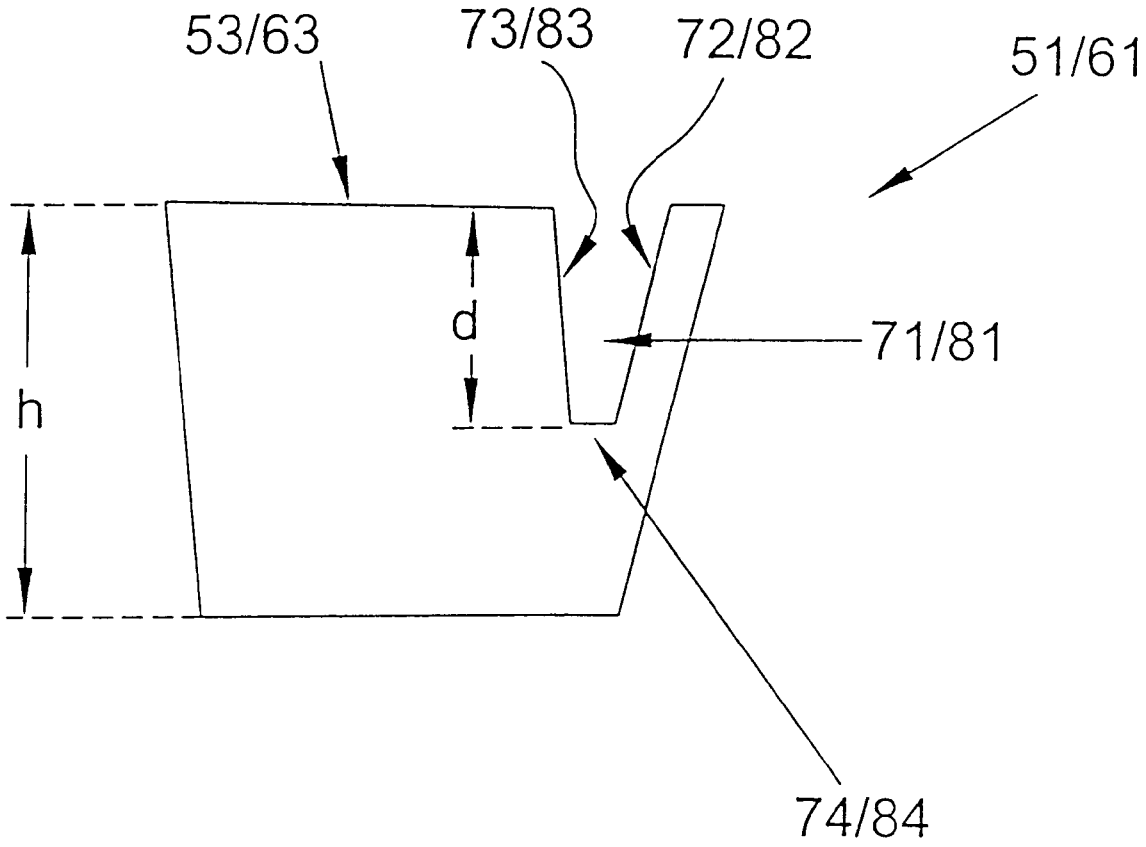
FIG. 7 is a side view of a tangential wall of a bucket showing a channel in the tangential wall, according to one embodiment of the invention.

FIG. 7 is a side view of a tangential wall 51/61 of bucket 5, according to one embodiment of the invention. Tangential wall 51/61 of FIG. 7 may represent either left tangential wall 51 as seen from within cup 20, or may represent right tangential wall 61 as seen from outside cup 20. Left and right channels 71/81 in tangential wall 51/61 are formed by outer face 72/82 and inner face 73/83 which taper together towards base 74/84. The depth d of left and right channels 71/81 may vary according to, inter alia, the height h of tangential walls 51/61. In general, the ratio of height h to depth d (h:d) is in the range of from about 10:2 to about 10:8; more preferably the ratio of height h to depth d is in the range of from about 10:4 to about 10:7; and most preferably the ratio of height h to depth d is about 10:6.

Left and right channels 71/81 may be located at various positions in left and right tangential walls 51/61. However, preferably, channel outer face 72/82 is located from about 55–100% of the distance from main wall 40 to bucket inner side 12*a*. Thus in the extreme case where left and right channels 71/81 are located 100% of the distance from main wall 40 to bucket inner side 12*a*, channel outer face 72/82 becomes, or is replaced by, bucket inner side 12*a*. More preferably, channel outer face 72/82 is located from about 75–95% of the distance from main wall 40 to bucket inner side 12*a*.

The distance between channel inner face 73/83 and channel outer face 72/82 (i.e. that distance corresponding to the width of left or right channel 71/81) may vary depending, inter alia, on the viscosity of a liquid to be contained and/or transferred within bucket 5. Generally the distance between channel inner face 73/83 and channel outer face 72/82 will be from about 1/25 to 1/3 of the total distance between main wall 40 and bucket inner side 12*a*. Whereas left and right channels 71/81 shown in FIG. 5 are generally wedge shaped with outer faces 72/82 and inner faces 74/84 tapering downwards, other shapes for channels are also possible under the invention. Similarly, while a single left or right channel 71/81 is shown in each tangential wall 51/61, two or more channels or perforations in each tangential wall 51/61 are possible according to other embodiments of the invention.

Figure 8:
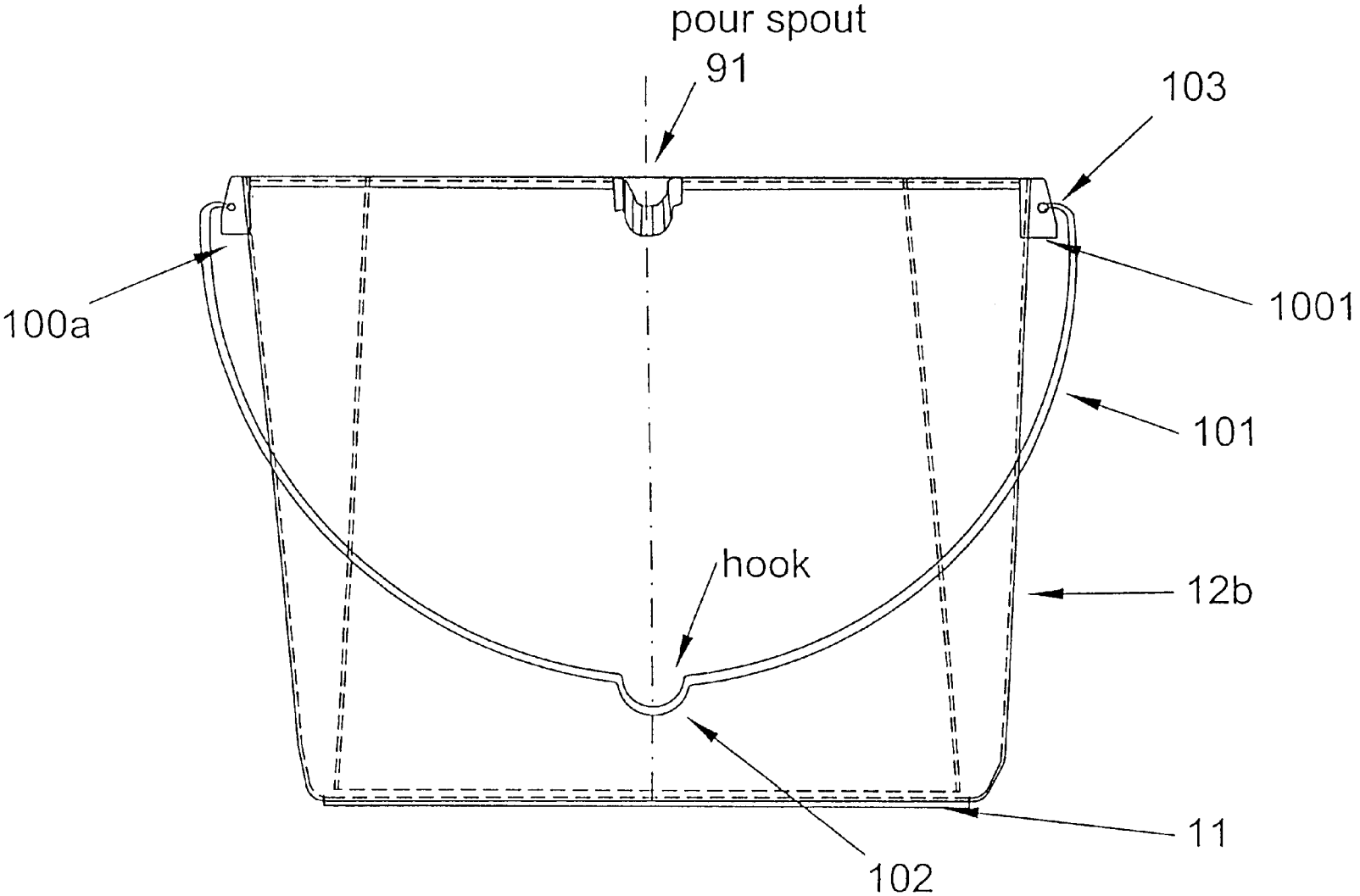
FIG. 8 is a side view of a bucket from the rear showing a first pouring spout and the handle of the bucket, according to one embodiment of the invention.

Bucket 5 in its various embodiments may optionally include a handle 101. FIG. 8 is a side view of bucket 5 showing first pouring spout 91 and the handle 101 draped or leaning against bucket outer side 12*b*. According to one embodiment of the invention, handle 101 is composed of wire of cylindrical cross-section, and of sufficient gauge to adequately support the weight of bucket 5, including its component parts, and any contents contained by bucket 5. Handle 101 is attached to left and right handle brackets 100*a,b*. A handle hook 102 may be included in handle 101 at a point equidistant, or substantially equidistant, from left and right handle brackets 100*a,b*. Handle hook 102 may conveniently serve to hang bucket 5 from a crook, paint hook, or horizontal support via handle 101. (Note that neither a crook nor a horizontal support are shown, and neither are a part of the instant invention.) Handle 101 is attached to left and right handle brackets 100*a,b* respectively via left and right handle sockets 103*a,b* respectively (not shown). Left and right handle brackets 100*a,b* are in turn attached to body 10 of bucket 5 near bucket rim 30, at a position approaching 8 o'clock and 4 o'clock, respectively, as seen in plan view (FIG. 2B). Other locations for left and right handle brackets 100*a,b* are also possible under the invention, for example, 9 o'clock and 3 o'clock, 8 o'clock and 3 o'clock, and 9 o'clock and 4 o'clock.

Figure 9A:
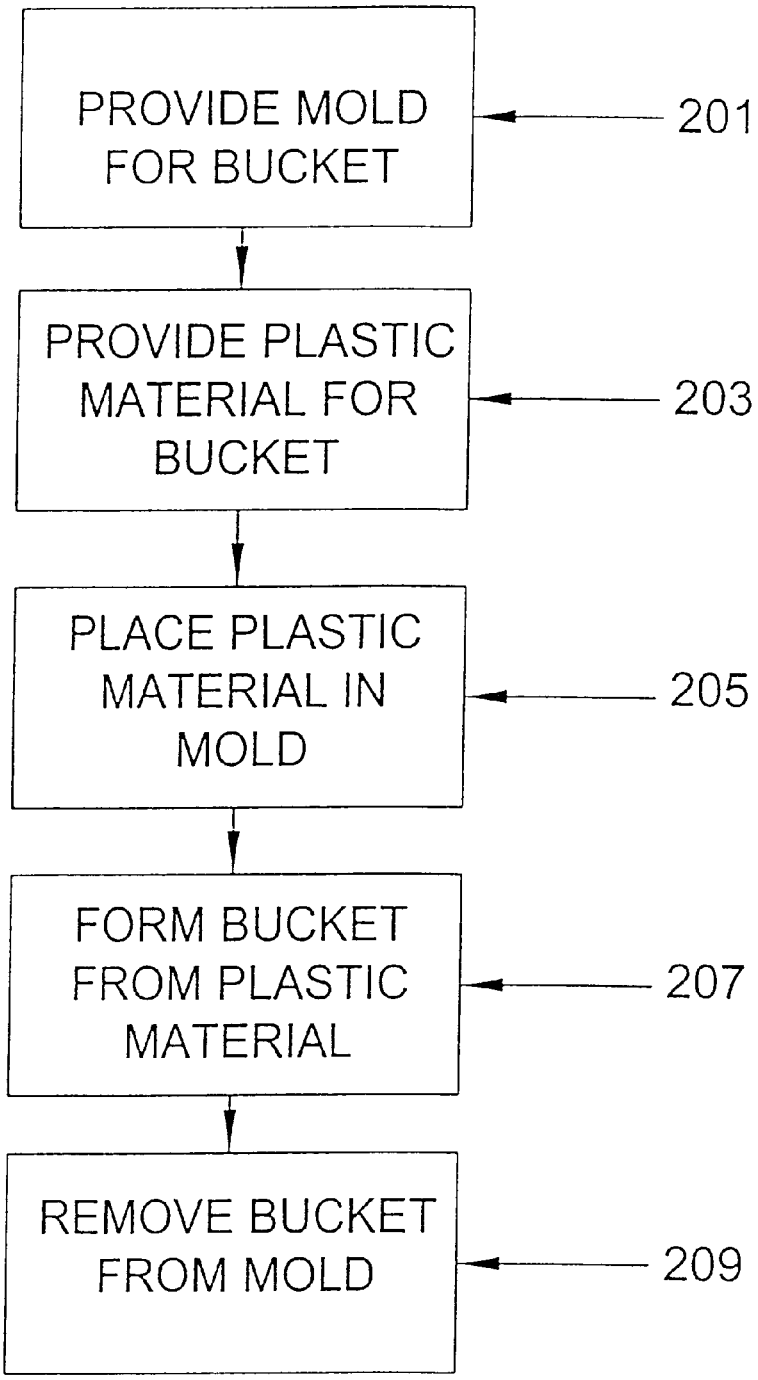
FIG. 9A schematically summarizes steps involved in a method of making a plastic bucket, according to another embodiment of the invention.

FIG. 9A schematically summarizes steps involved in a method of making a plastic bucket, according to another embodiment of the invention, in which step 201 involves providing a mold for bucket 5. By definition a mold for bucket 5 will have certain features, elements, or portions which correspond to the features and elements of bucket 5 as described above in relation to FIGS. 1–8. Thus step 201 involves providing a mold which may include a body portion, a bucket base portion, a bucket outer side portion, a main compartment portion, a cup compartment portion, and a channel portion disposed between the main compartment portion and the cup compartment portion. A mold provided in step 201 may further include an internal wall portion or a bucket inner side straight section portion. Further a bucket rim portion of the mold may include at least one pouring spout portion. According to different embodiments of the invention, the cup compartment portion of the mold may be internal, external, or partially external to bucket outer side portion of the mold.

According to a preferred embodiment of the invention, bucket body 10, including main compartment 16, and integral cup 20 are formed as a unit by molding from a single type of plastic material, and consequently body 10, cup 20, as well as other internal components of bucket 5 will normally share a common composition. Step 203 involves providing plastic or other suitable material from which bucket 5 is to be constituted. A preferred material to be provided in step 203 and from which bucket 5 is to be constituted is polyethylene, more preferably high density polyethylene. Step 205 involves placing the plastic material provided in step 203 into the mold provided in step 201. Then step 207 involves forming bucket 5 from the plastic material. Finally step 209 involves removing bucket 5 from the bucket mold of step 201.

Figure 9B:
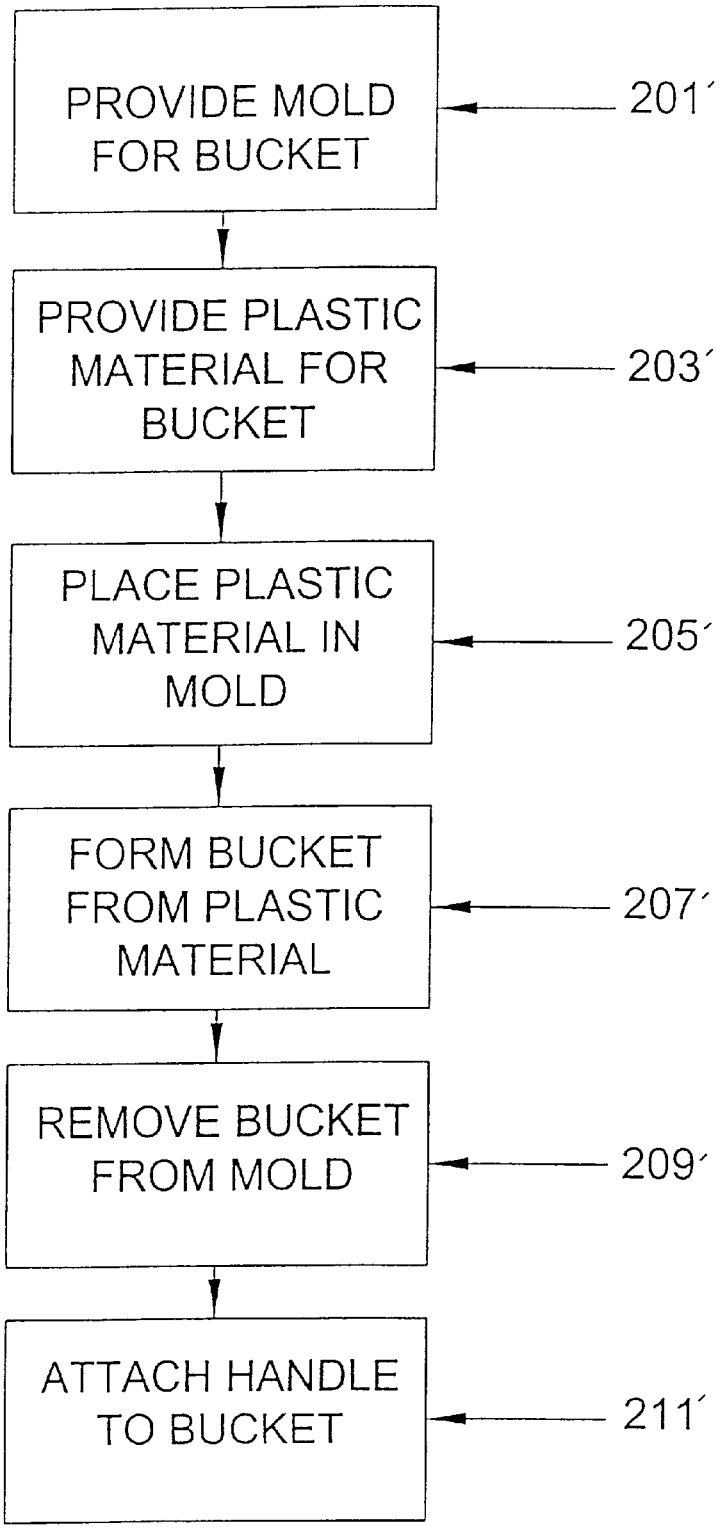
FIG. 9B schematically summarizes steps involved in a method of making a plastic bucket, according to another embodiment of the invention.

According to another embodiment of the invention, as represented by FIG. 9B, steps 201' through 209' of FIG. 9B are analogous to steps 201 through 209 of FIG. 9A. After step 209' handle 101 is attached to bucket 5 at left and right handle brackets 100*a*, 100*b* in step 211'. Unlike body 10 and various internal components of bucket 5, handle 5 may comprise a material other than plastic. A preferred material for handle 101 is a length of wire, such as aluminum wire, steel wire, or similar material. Handle 101 may include a handle hook 102, from which bucket 5 may be suspended.

Figure 10A:
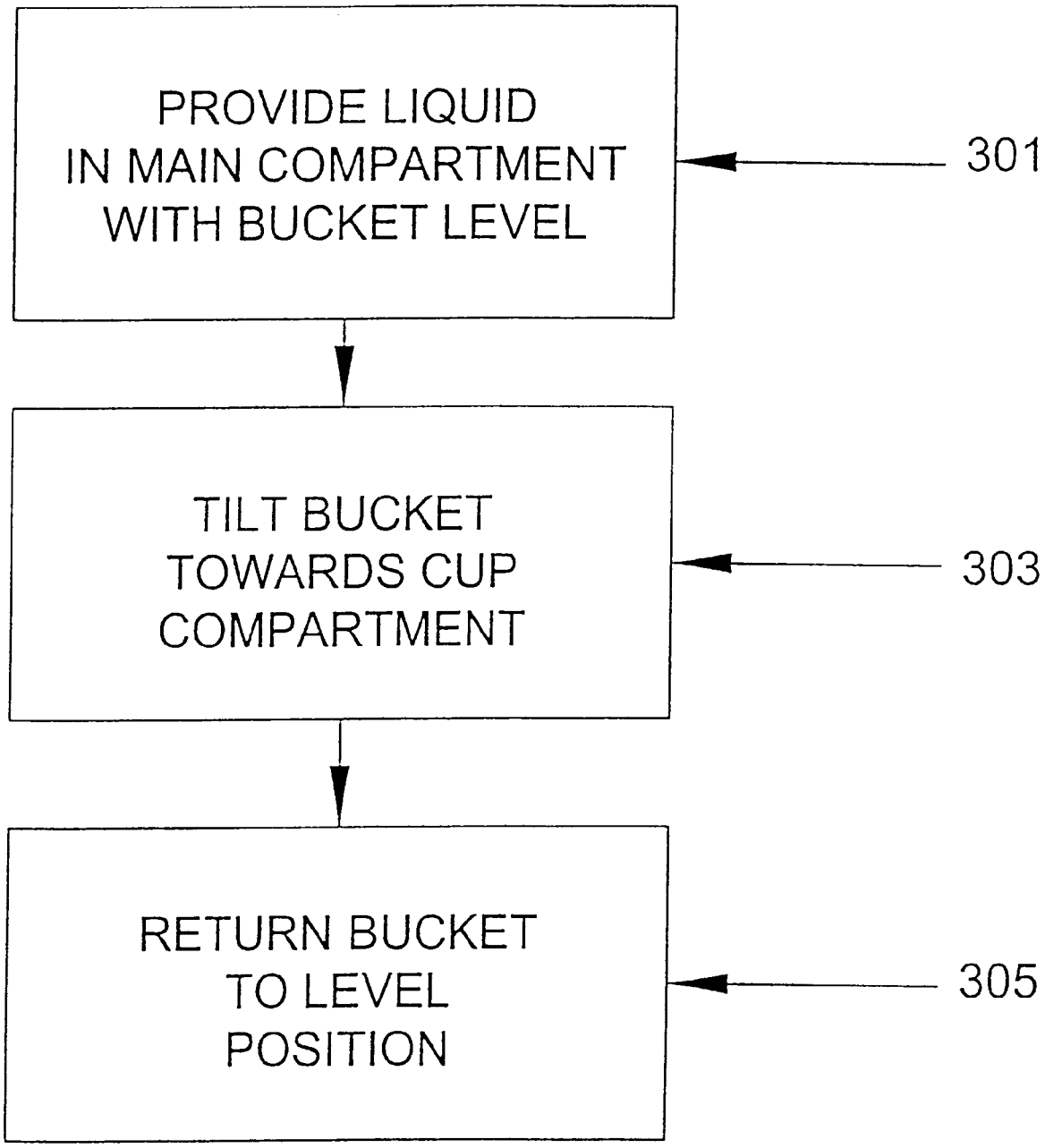
FIG. 10A schematically summarizes steps involved in a method of transferring liquid between the main compartment and the cup compartment of a plastic bucket, according to another embodiment of the invention.

FIG. 10A schematically summarizes steps involved in a method of transferring liquid from main compartment 16 to cup compartment 20 of a bucket having no internal walls therein, according to one embodiment of the invention, in which step 301 involves providing a quantity of liquid in main compartment 16, with bucket 5 in a substantially level or horizontal position. Step 303 involves tilting bucket 5 towards cup compartment 20 to a suitable extent sufficient to allow a desired amount of liquid to flow, through at least one channel, from main compartment 16 to cup compartment 20. In the case of a method using a bucket having a single channel (e.g. channel 70) which extends the complete length of straight section rim 30', step 303 may involve tilting the bucket directly towards second pouring lip 92. On the other hand where left and right channels 71/81 are present in straight section rim 30', step 303 may involve tilting bucket 5 towards either left channel 71 or right channel 81. A quantity of liquid so transferred to cup 20 is retained therein, even though bucket 5 may subsequently be tilted in the opposite direction, i.e. towards first pouring spout 91.

Step 305 of FIG. 10A involves returning bucket 5, and concomitantly cup 20, to a level or horizontal position. A quantity of liquid may then be retained within cup 20. In the case of the liquid being paint, the paint can be easily accessed for loading on a paint brush or the like for painting trim, corners, etc. A quantity of liquid retained within cup 20 may also be conveniently poured therefrom via second pouring spout 92 by tilting bucket 5 to a sufficient extent in a direction towards second pouring spout 92.

Figure 10B:
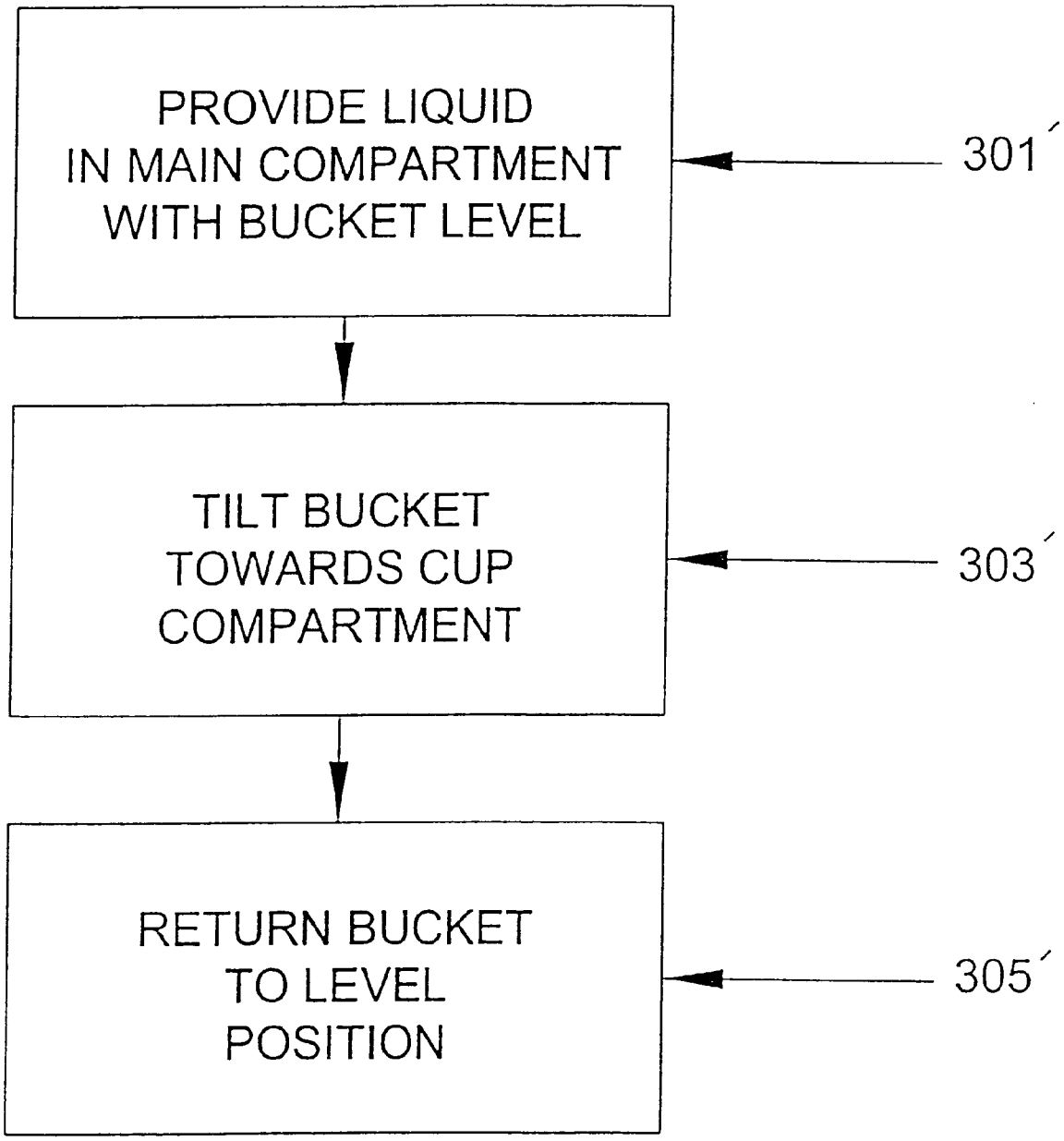
FIG. 10B schematically summarizes steps involved in a method of transferring liquid between the main compartment and the cup compartment of a plastic bucket, according to another embodiment of the invention.

FIG. 10B schematically summarizes steps involved in a method of transferring liquid from main compartment 16 to cup compartment 20, according to another embodiment of the invention, in which the bucket includes as internal walls a main wall and left and right tangential walls, the latter having left and right channels 71/81 therein. According to FIG. 10B step 301' involves providing a quantity of liquid in main compartment 16, with bucket 5 in a substantially level or horizontal position. Step 303' involves tilting bucket 5 towards cup compartment 20. As bucket 5 is tilted towards cup compartment 20, liquid flows preferentially from rear main compartment base 17*b* into front main compartment base 17*a*. Since the volume of a liquid in a vessel is a function of the height or depth of the liquid and the surface area of the base of the vessel, and because front main compartment base 17*a* has a smaller surface area than rear main compartment base 17*b*, a given volume of liquid in front main compartment base 17*a* has a substantially greater height, or depth, than the same volume of liquid in main compartment base 17 as a whole, or in rear main compartment base 17*b*. The substantially greater depth of liquid in front main compartment base 17*a* when bucket 5 is tilted to a sufficient extent towards cup 20 allows liquid to flow through left and right channels 71/81 and into cup 20. A quantity of liquid so transferred to cup 20 is retained therein, even though bucket 5 may be tilted to a similar or greater extent in the opposite direction, i.e. towards first pouring spout 91. Step 305' of FIG. 10B involves returning bucket 5, and concomitantly cup 20, to a level or horizontal position. A quantity of liquid may then be retained within cup 20.

Figure 11:
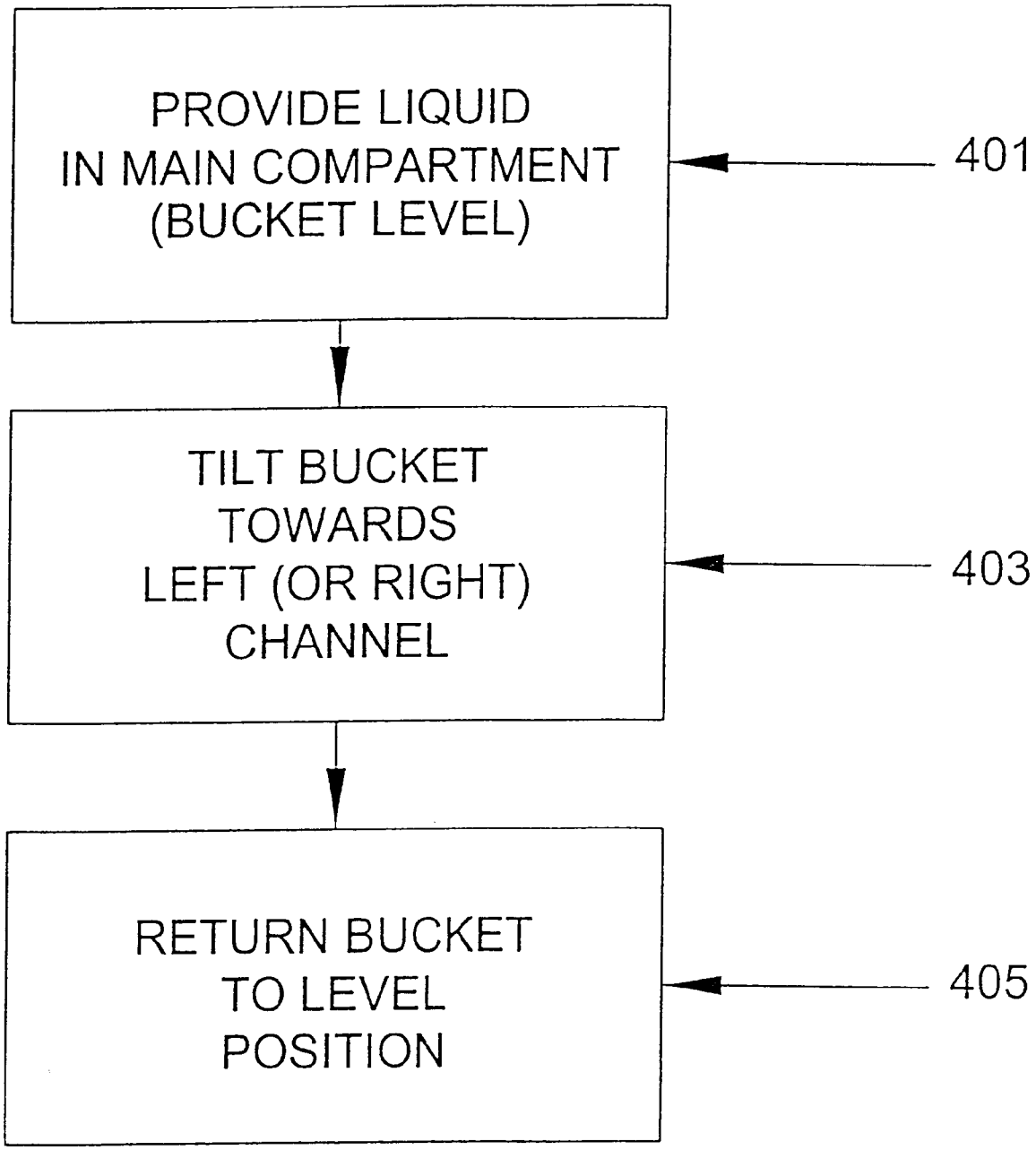
FIG. 11 schematically summarizes steps involved in a method of transferring liquid between the main compartment and the cup compartment of a plastic bucket, according to another embodiment of the invention.

FIG. 11 schematically summarizes steps involved in a method of transferring liquid from main compartment 16 to cup compartment 20 of bucket 5, according to another embodiment of the invention, wherein bucket 5 has left (or first) and right (or second) tangential walls having left and right channels, respectively, therein. Step 401 involves providing at least a relatively small quantity of liquid in main compartment 16 of bucket 5, with bucket 5 in substantially a level or horizontal position, such that liquid is evenly distributed over main compartment base 17 to a depth of approximately 1/20th to about 1/5th the height of main compartment 16. Step 403 then involves tilting the bucket towards, for example, left channel 71. As a result liquid flows preferentially towards left channel 71 and accumulates between left rounded edge 43, left side 55 of left tangential wall 51, and bucket inner side 12*a* (FIGS. 2B, 2E, 2F). Since the volume of a liquid in a vessel is a function of the height or depth of the liquid and the surface area of the base of the vessel, and because the region of main compartment base 17 bounded by left rounded edge 43, left side 55 of left tangential wall 51, and bucket inner side 12*a* has a much smaller surface area than main compartment base 17 as a whole, a given volume of liquid in the region of main compartment base 17 bounded by left rounded edge 43, left side 55 of left tangential wall 51, and bucket inner side 12*a* has a substantially greater height, or depth, than the same volume of liquid in main compartment base 17 as a whole. Consequently, as bucket 5 is tilted towards left channel 71 to a sufficient extent, the depth of liquid increases to a sufficient extent to cause liquid to flow through left channel 71 into cup 20. Tilting of bucket 5 towards left channel 71 may be continued until sufficient quantity of liquid has been transferred from main compartment 16 to cup compartment 20. At this point in time, step 405 involves returning bucket 5 to the horizontal position, in which position liquid so transferred to cup 20 is retained therein. Liquid retained within cup 20 may, once again, be conveniently decanted from cup 20 via second pouring spout 92 by tilting bucket 5 to a sufficient degree towards second pouring spout 92.

While the bucket-like receptacle has been described herein primarily with respect to a paint bucket, it is to be understood that certain embodiments of the instant invention may also be applicable to containing other liquids as well as non-liquid materials, for example, various powders, granular materials, etc. The foregoing embodiments are merely exemplary and are not to be construed as limiting the present invention. The methods of the present invention can be readily applied to other types of apparatuses. The description of the present invention is intended to be illustrative, and not to limit the scope of the claims. Many alternatives, modifications, and variations will be apparent to those skilled in the art.

What is claimed is:

1. A bucket for containing liquid, the bucket having a substantially round upper rim and comprising:

a main compartment, having a bucket floor; and a cup compartment having a cup floor, the cup compartment being integral with said bucket and separated from the main compartment by a separation wall, the separation wall defining at least a part of a chord of the upper rim, wherein at least one channel is disposed at an end of the separation wall between said main compartment and said cup compartment and follows a contour of a sidewall of the bucket, a lower surface of the channel is lower than an upper surface of the separation wall and higher than lower surfaces of the main and cup compartments such that material in the main compartment can flow into the cup compartment without flowing over a top of the separation wall, and a level of the bucket floor differs significantly from a level of the cup floor.

2. The bucket for containing liquid as claimed in claim 1, further comprising a bucket inner side straight section disposed in said main compartment, wherein said bucket inner side straight section provides a substantially planar surface suitable for distributing paint on a paint roller.

3. The bucket for containing liquid as claimed in claim 1, wherein the top of the separation wall includes left and right ends, and wherein the at least one channel comprises left and right channels, said left and right channels being located at a left end and a right end, respectively, of the top of the separation wall.

4. The bucket for containing liquid as claimed in claim 1, further comprising at least one internal wall.

5. A bucket for containing liquid, comprising:

a main compartment for containing a liquid, said main compartment having a bucket rim and a bucket floor, the bucket rim being substantially round;

a cup compartment for containing a liquid and having a cup floor that is higher than the bucket floor;

a bucket outer side;

a bucket inner side, said bucket inner side including a substantially planar bucket inner side straight section suitable for accommodating a paint roller, said bucket inner side straight section having a straight section rim, said straight section rim defining at least a part of a chord of the bucket rim and being lower than said bucket rim; and at least one channel, wherein the channel is located adjacent an end of the straight section rim and follows a contour of a side wall of the bucket, and wherein a lower surface of the channel is lower than the straight section rim and higher than both the cup floor and the bucket floor.

6. The bucket for containing liquid as claimed in claim 5, wherein said bucket inner side straight section includes a plurality of indentations thereon.

7. The bucket for containing liquid as claimed in claim 5, wherein said straight section rim is arranged between said cup compartment and said main compartment, and wherein a liquid in the main compartment can flow through the at least one channel into said cup compartment without flowing over the straight section rim.

8. The bucket for containing liquid as claimed in claim 5, wherein said straight section rim has a left edge and a right edge, and said at least one channel comprises a left channel and a right channel located adjacent said left edge and said right edge, respectively.

9. The bucket for containing liquid as claimed in claim 5, wherein said bucket includes a first pouring spout for decanting liquid from said main compartment.

10. The bucket for containing liquid as claimed in claim 5, wherein said bucket includes a second pouring spout for decanting liquid from said cup compartment.

11. The bucket for containing liquid as claimed in claim 5, wherein said bucket further includes a handle, said handle comprising a length of wire, said handle having a generally semi-circular configuration, and said handle including a handle hook, said handle hook for suspending said bucket therefrom.

12. A multipurpose paint bucket having a substantially round upper rim and comprising:

a main compartment;

a cup compartment integral with said paint bucket, wherein a height of the main compartment differs significantly from a height of the cup compartment;

a separation wall that separates the cup compartment from the main compartment, the separation wall having a substantially planar surface suitable for distributing paint on a paint roller; and at least one channel disposed at an end of the separation wall between said main compartment and said cup compartment and following a contour of a sidewall of the main compartment, wherein a floor of the channel is below a top edge of the separation wall and above floors of the main and cup compartments and the top edge of the separation wall defines at least a part of a chord of the upper rim.

13. The multipurpose paint bucket as claimed in claim 12, wherein said substantially planar surface suitable for distributing paint on a paint roller comprises a main wall.

14. The multipurpose paint bucket as claimed in claim 12, wherein said substantially planar surface suitable for distributing paint on a paint roller comprises a bucket inner side straight section.

15. The multipurpose paint bucket as claimed in claim 12, wherein said cup compartment can function as a handle for said paint bucket.

16. The multipurpose paint bucket as claimed in claim 12, wherein said bucket comprises molded plastic.

17. A bucket for containing a liquid, comprising:

a body including a bucket base and a bucket rim, the bucket rim being substantially round;

a main compartment for holding a liquid;

a cup integral with said body, said cup separated from said main compartment by at least one internal wall, said at least one internal wall internal to said body and having an upper edge that defines at least a part of a chord of the bucket rim; and at least one channel passing through the at least one internal wall, located at an end of the internal wall and following a contour of a sidewall of the bucket, wherein a lower surface of the channel is lower than an upper surface of the at least one internal wall and higher than lower surfaces of the main compartment and the cup, and wherein a height of the main compartment significantly exceeds a height of the cup.

18. The bucket as claimed in claim 17, wherein said at least one internal wall comprises a main wall and at least one tangential wall, and said at least one tangential wall includes the at least one channel, said at least one channel for allowing transfer of liquid from the main compartment to the cup.

* * * * *